US006155009A

United States Patent [19]

Pena

[11] Patent Number: 6,155,009

[45] Date of Patent: Dec. 5, 2000

[54] WINDOW AND DOOR GLASS PROTECTION SYSTEM AND METHOD

[76] Inventor: Martin Rangel Pena, 11039 Painted Tree Rd., Charlotte, N.C. 28226

[21] Appl. No.: 09/310,418

[22] Filed: May 12, 1999

[51] Int. Cl.[7] ..... E06B 3/26

[52] U.S. Cl. ..... 52/202; 52/171.3

[58] Field of Search ..... 52/171.3, 202, 52/203; 428/40.1, 34; 248/205.8

[56] References Cited

U.S. PATENT DOCUMENTS

| | | | |
|---|---|---|---|
| 4,544,587 | 10/1985 | Nesbitt . | |
| 4,844,395 | 7/1989 | Perentin | 248/205.8 |
| 5,773,110 | 6/1998 | Shields | 52/171.3 |

*Primary Examiner*—Beth A. Stephan
*Attorney, Agent, or Firm*—Dorothy S. Morse

[57] ABSTRACT

A low cost, reusable, easily installed and removed, locking security system and method for protecting the glass in windows and doors. The bottom panel of the preferred embodiment is installed from the outside of the building against the bottom part of a glass window or door with at least one locking-pin suction cup. The top panel or panels are then rotated upwardly away from the bottom panel and secured successively against the upper part of the glass with cord-release suction cups which are individually pressed into place for best adhesion. Removal of the system is accomplished by unlocking the padlock on each locking-pin suction cup, and raising the bottom panel to reveal release cords attached to suction cups behind the It next adjacent upper panel. A downward force then applied to each of the exposed ends of the release cords, breaks the gripping connection between the associated suction cup and the protected glass. When all suction cups behind a panel are released, it can be raised to expose the rings for releasing suction cups behind the next adjacent panel until the uppermost panel is free to be pulled away from the protected glass. Neither installation or removal requires tools. As Also, installation does not permanently alter the window or door frame, or any part of the building surrounding the frame. Applications may include, but are not limited to, use in protecting windows in commercial buildings from such hazards as storm debris, vandalism, burglary, and unauthorized entry.

20 Claims, 12 Drawing Sheets

FIG.6a
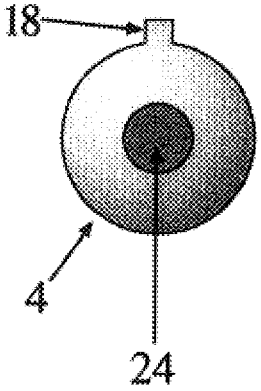
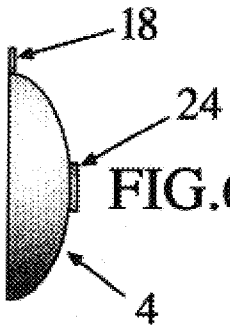
FIG.6b
FIG.6c
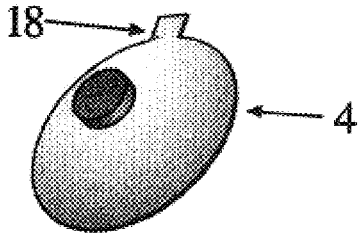
FIG.6d
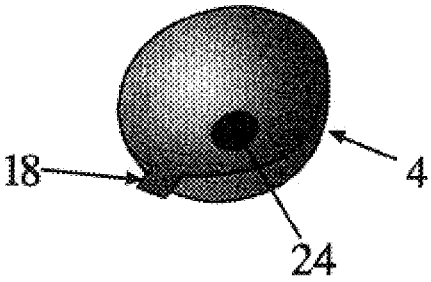
FIG.6e
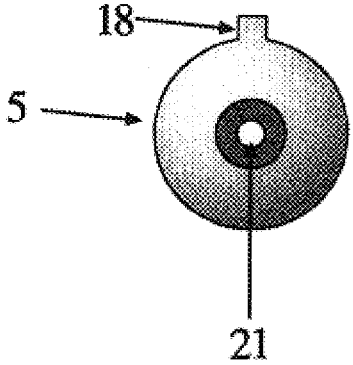
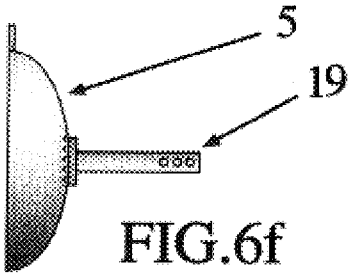
FIG.6f
FIG.6h
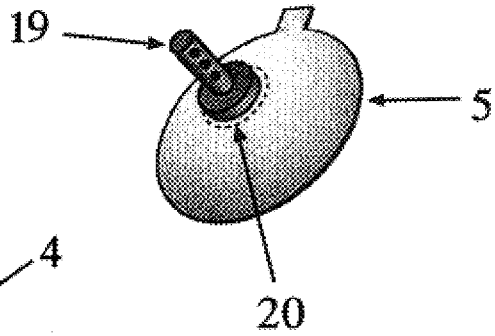
FIG.6g
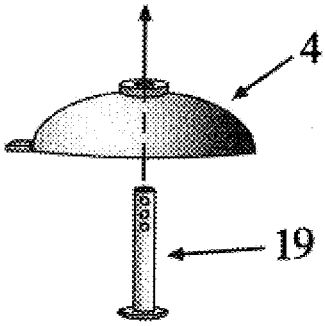

FIG.6i
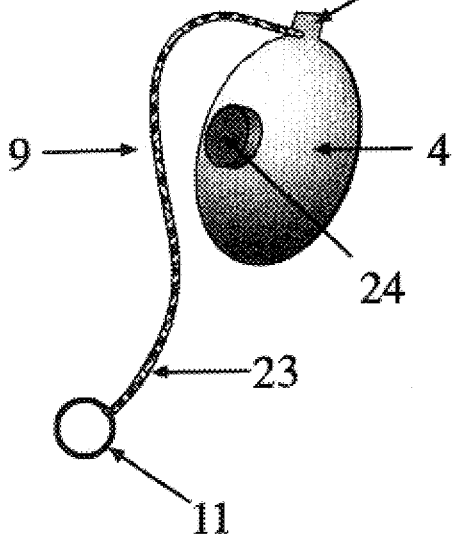
FIG.6j
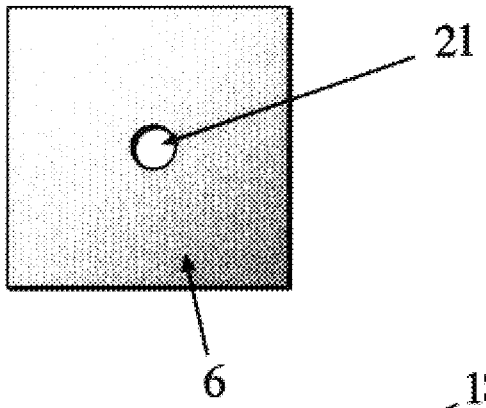
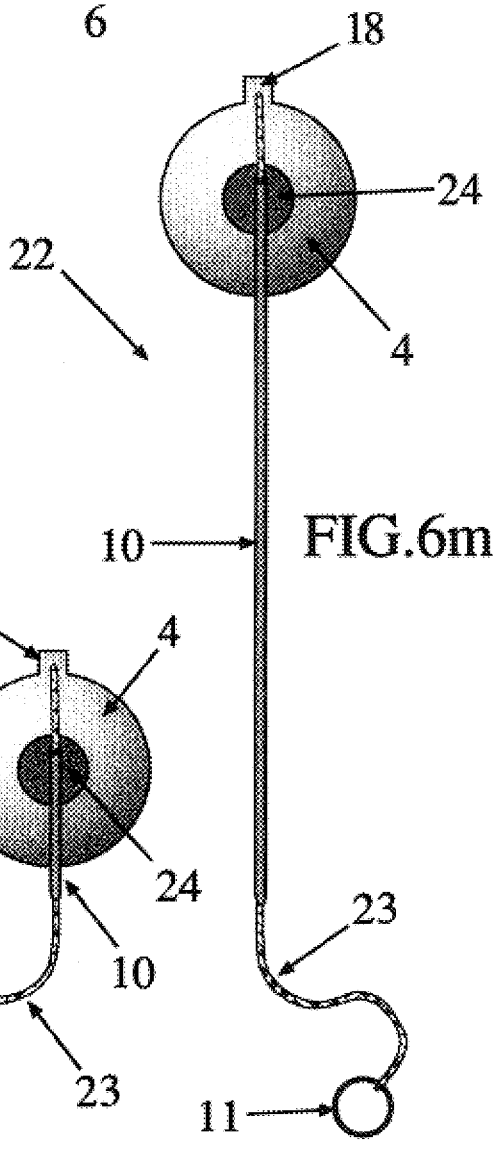
FIG.6m
FIG.6l
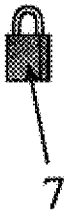
FIG.6k

FIG.11a
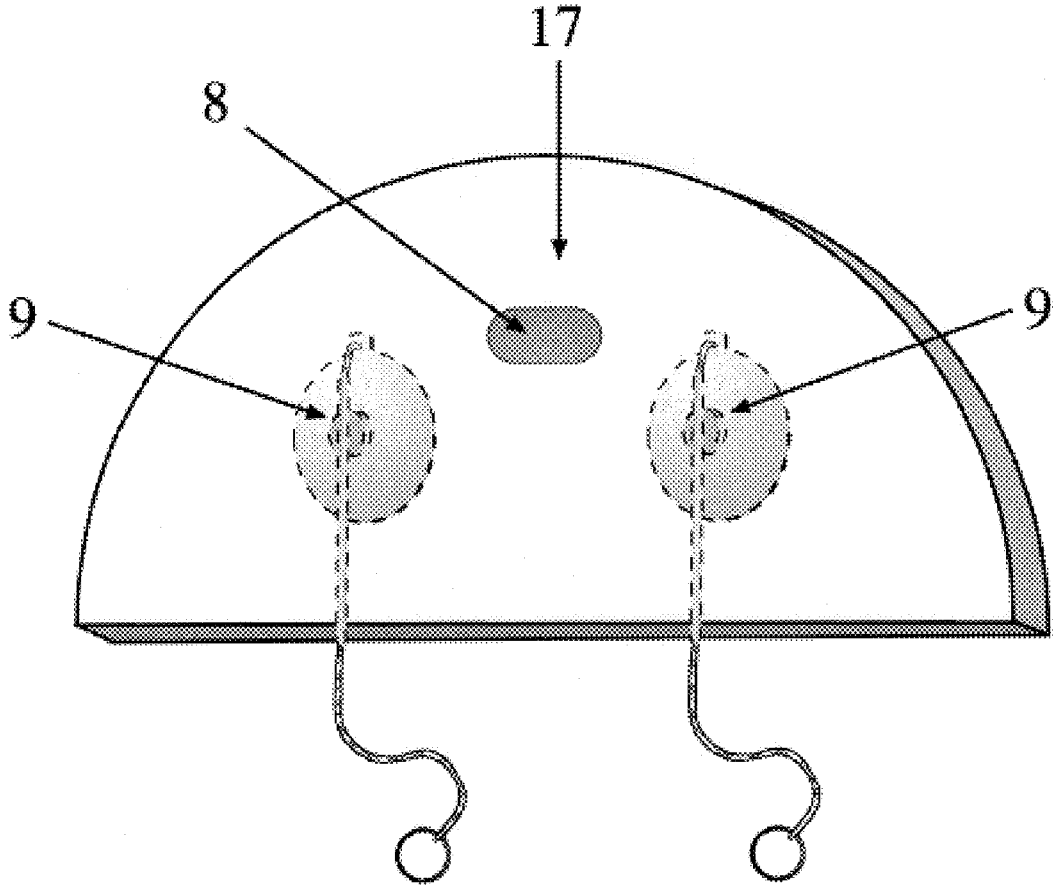
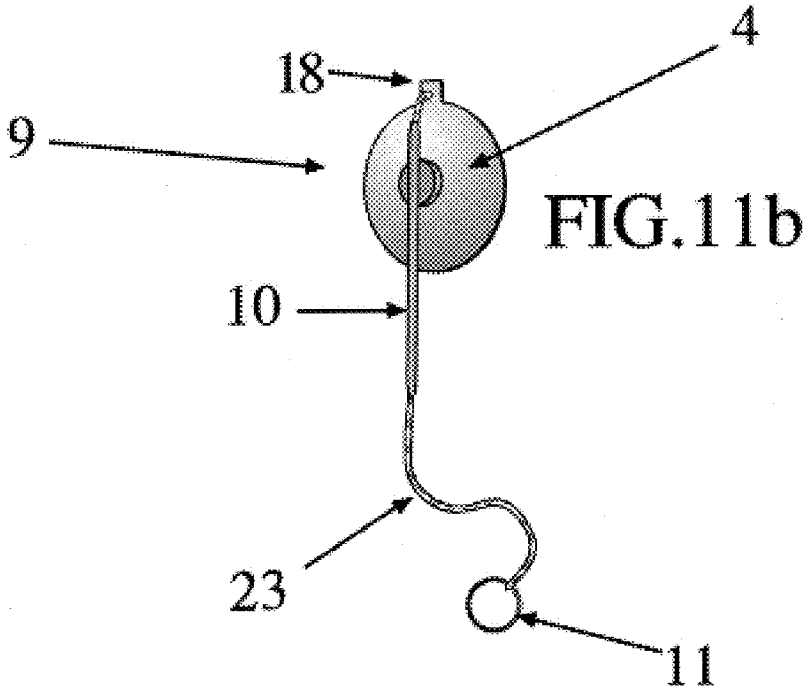
FIG.11b

WINDOW AND DOOR GLASS PROTECTION SYSTEM AND METHOD

BACKGROUND

1. Field of Invention

This invention relates to devices used to protect windows and glass doors from storm damage and vandalism, specifically to a reusable security system and method for protecting glass in windows and doors that contemplates the use of at least two panels made of rigid shatter-resistant material which are hinged together and attach to the glass through the use of suction cups. Spacers made of impact-absorbing material are attached to the rear surface of each panel, the surface facing the protected glass, centrally between adjacent suction cups. In the several different embodiments considered a part of this invention, three different types of suction cups are used in varying combinations, to secure the hinged panels to the protected glass however, at least one locking-pin suction cup is generally provided to attach the bottom panel to the protected glass so as to lessen the likelihood of unauthorized removal. The present invention does not require any tools for installation, does not permanently alter the window or door frame of the glass it protects, nor does it damage or permanently alter any part of the building surrounding the frame. Although not limited thereto, applications are particularly suited for the protection of ground floor display windows in commercial buildings as well as glass doors to include sliding glass doors, from hazards such as storm debris, vandalism, and unauthorized entry.

2. Description of Prior Art

Display windows in commercial buildings are common targets of vandalism, particularly at night. Also, since they generally contain large panes of glass without central reinforcement, they are particularly vulnerable to damage from airborne debris generated by strong storms such as hurricanes, typhoons, and tornadoes, as well as breakage caused as a result of unauthorized entry. Every time glass in a commercial building is broken for any reason, the expense and inconvenience of repair adversely affects business. Automated window protection systems that are simply and rapidly activated at the beginning and end of every business day would be one solution for protecting commercial display windows from all of the above-mentioned hazards. The disadvantage is that these systems are generally beyond the budget of many small businesses. Less complex permanently installed glass protection systems which have manual control instead of automatic operation might also be used by some businesses to protect glass windows and doors, however such systems take more time to operate than automatic systems, they can also be expensive and require professional maintenance, and they permanently alter the building to which they are attached which may not be permitted by a lease. Static metal bars and grates can also be permanently installed over display windows as a deterrent to unauthorized entry, and alarm systems can be installed Us for the same purpose. However, both are expensive to install and neither is a complete solution against the breakage of glass caused by vandalism and storm debris. A further disadvantage to metal bars is that they can create a negative impact on customers. The present invention provides an alternative security option that is less expensive than the above-mentioned protective measures against breakage of glass in windows and doors, and it can be used to protect glass against vandalism, storms, as well as unauthorized entry. It is also reusable, easily transportable, compactly stored, usually installed by no more than two people, installed without tools, it does not permanently alter the glass frame or adjacent building surfaces, and it has a security feature that minimizes unauthorized removal.

Since use of the present invention is lower in cost than the other security options mentioned above, it might also be advantageous for business owners who might otherwise simply rely on plywood or adhesive tape as a temporary measure to protect window or door glass during hurricanes and other storms having potentially damaging winds. Tape only minimally protects against glass breakage, mainly minimizing glass dispersion after breakage. Conversely, plywood will provide a higher level of protection against glass breakage, however it has many disadvantages which are overcome by the present invention. Plywood is bulky and heavy to use, and it is not as compactly stored between uses. Further, plywood is often discarded after each temporary storm protection use, and even if it is needed only once per year, the repetitive purchase cost of plywood can be greater than a one time purchase of the present invention since one must also consider the time it takes for someone to purchase the plywood, load and unload it, transport it to the installation site, measure it, cut it, align it, and securely nail each piece into position. Also, unless plywood and tape are timely purchased, a business owner not stocking it risks the last minute unavailability due to storm induced shortages. Further, plywood must be skillfully nailed or it can come loose during a storm. Each piece of loosened plywood could then become a wind-borne projectile causing damage to others. In addition, plywood is not secure against intruders as it can be removed from the outside of the building by anyone using a prying type of tool. Since the present invention can be made from transparent and translucent materials, it can be installed at the beginning of a tornado, hurricane, or other storm season and left in place for the duration of the storm season, whereas plywood left in place for extended periods of time would be unsightly and detract from the aesthetic appearance of the building, and it would block all light entry through the glass it was installed to protect. Plywood installation also causes permanent alteration to the frame of the protected glass or the building surface immediately adjacent to the frame, and if plywood is repeatedly installed, the frame or portion of the building to which it has been attached will ultimately will require repair.

While suction cups have been used to attach many things to window glass, including sunshields, vehicle-mounted message displays, camera mounts, decorative ornaments, ski racks, bird nesting apparatus, bird feeders, anti-glare screens, thermometers, and the like, it is not known to have a protective security system for reducing glass breakage due to storm damage, vandalism, and unauthorized entry that attaches to the glass in windows and doors through the use of suction cups. The invention believed to be the closest in concept to the present invention is the disclosure in U.S. Pat. No. 4,544,587 to Nesbitt (1985). The Nesbitt invention comprises a heat insulator for windows having a pair of flexible plastic layers with partitions therebetween for forming air pockets. The flexible material used in the Nesbitt invention is pervious to light and it has rows of grooves alternating with rows of suction cups to provide mounting suction means to a pane of glass. The present invention can be distinguished from the Nesbitt invention since the present invention has hinged rigid panels; long-cord, short-cord, and locking-pin suction cups; impact-absorbing spacers centrally positioned between adjacent suction cups; flexible tube housings for guiding movement of the suction cup cords; and hand-gripping indentations on the outside surface of the panels, none of which is taught by the Nesbitt disclosure.

SUMMARY OF INVENTION—OBJECTS AND ADVANTAGES

It is the primary object of this invention to provide a reusable window and door glass protection system that does not permanently alter any part the glass frame or building surface adjacent to the frame and which provides glass protection against breakage due to acts of vandalism and unauthorized entry, as well as contact with storm debris. It is a further object of this invention to provide a window and door glass protection system that under routine conditions can be easily installed and removed by only one or two people of ordinary strength and coordination, and without any tools other than the optional use of a ladder or lift. It is also an object of this invention to provide a window and door glass protection system which cannot be easily removed by unauthorized persons. A further object of this invention is to provide a window and door glass protection system that does not unduly detract from the aesthetic appearance of the building to which it is attached. It is a further object of this invention to provide a window and door glass protection system that is made from materials that do not unduly deteriorate upon extended exposure to the sun and other environmental elements. It is also an object of this invention to provide a window and door glass protection system which can be compactly stored when not in use and requires little or no refurbishment between uses. A further object of this invention is to provide a window and door glass protection system that is sufficiently simple in design for inexpensive manufacture and affordable pricing to allow widespread use. It is also an object of this invention to provide a window and door glass protection system that can easily accommodate alternative materials that diversify its use, such as materials which would make the protective panels bulletproof or one-way thermally conductive, as well as materials which would decoratively enhance the protective panels.

As described herein, properly manufactured and installed over the glass of a window or door, the present invention would provide an easy and rapidly installed storm protection and security system that would protect a building's interior from damage due to wind, rain, vandalism, and unauthorized entry. No tools would be required to install it, other than the possible use of a ladder or lift for large windows or those above the ground floor, and it would not damage or permanently alter the glass frame or building surface surrounding the frame since attachment is provided through the use of suction cup adhesion directly against the protected glass. The system would comprise at least two protective panels hinged together on their front surfaces, the surfaces facing away from the protected glass, to allow the protective panels to be easily folded and unfolded during both installation and removal of the panels from their protective positions. It is contemplated for each protective panel to have several suction cups attached to its rear surface in strategic positions for secure engagement with the outside surface of the glass in an exterior window or door. Three different type of suction cups are contemplated for use, locking-pin suction cups each having an attached padlock, long-cord suction cups, and short-cord suction cups. Although not critical, at least one locking-pin suction cup is used with most preferred embodiments of the present invention to prevent unauthorized removal of the panels from their protective positions. Also, for most applications the locking-pin suction cups would be used with bottom protective panels so that the padlocks remain within easy reach of the person installing and removing them. Spacer blocks made from an energy-absorbing material or impact foam, such as poron polyurethane foam which has a maximum deflection of approximately 30%, are attached to the protective panels centrally between adjacent suction cups to act as spacers between the protective panels and the protected glass so as to allow unobstructed attachment of each suction cup to the glass and enhance the impact-absorbing capability of the present invention between the suction cups. Also, although not critical, the top panel in the preferred embodiment has one or more evenly spaced-apart, hand-gripping indentations on its front surface, near to its upper edge, for use as handles to provide ease in manipulating the present invention during installation and removal after use. The protective panels would be made from a durable, shatter-resistant material, such as but not limited to LEXAN, which provides an appropriate balance of lightweight material that also has good abrasion resistance and impact strength. The protective panels can also be made transparent, translucent, or opaque, and may even contain surface decoration, including advertising messages or company logos, depending upon the user's preference or need. In locations where extended periods of violent storm activity are predictable, such as hurricanes and tornadoes, transparent protective panels could be installed prior to the beginning of the predicted high-risk storm period and left in place for its duration since the transparent protective panels would not significantly diminish incoming light, since they would not detract from the aesthetic appearance of a building, and to be certain that they are in place prior to any storm event having little advance warning. Since the present invention is installed and removed from the outside of a building, particularly for residential application the windows and doors over which the present invention is installed for extended periods of time should not be those relied upon for emergency egress, unless installation does not interfere with the opening of the window or door. For embodiments of the present invention having large protective panels, it is contemplated that two or more people may be required for installation, however for windows effectively protected by smaller panels one person of average strength and coordination should be able to accomplish installation alone, with two people only being needed for installation during windy conditions and for inconveniently accessed windows. Although installing the present invention over upper story windows is not as easily accomplished as installation over ground floor windows, through the use of a ladder or a lift such installation could also be accomplished seasonally, or when a special security need is recognized. Bulletproof materials can further enhance the protective function of the present invention. When not in use, its hinges allow the present invention to be folded into at least a bi-fold configuration so that it can be more easily stored. Also, although the design of the present invention makes it suitable for manufacture in several standard sizes, it can also be custom-fit for protection of non-standard sizes of windows. The protective panels of the present invention would also provide a thermally insulating outer layer for the protected glass, and should the panel incorporate one-way thermal transfer materials, it could either add heat to a room in a cold climate or keep afternoon sunlight from excessively heating a room in a warm climate. Further, since the present invention is simple in design, it could be cost effectively manufactured for widespread use among cost-conscious business owners, yet still offer them an enhanced level of protection against storm debris, vandalism, and unauthorized entry. Residential owners having two or more sliding glass door frames positioned for movement with respect to one another could also receive similar benefit by using the present invention, particularly multiple sliding glass doors that extend from ceiling to floor and take the place of an entire building wall. However, it should be noted that while use of the present invention over the glass in the outermost sliding frame would not cause any movement restriction, use of the present invention over the glass in any of the rear sliding frames, due to the added thickness of the protective panel and suction cups attached thereto, would no longer allow that rear frame to move relative to the sliding frame next in front of it and the two frames could no longer be used as an emergency exit.

For simplicity of description, the installation steps for only a bi-folded embodiment of the present invention will follow. However, it should be understood that in embodiments having more than two hinged panels, installation and removal of each successive higher panel after the first will be similar to that of the upper bi-folded panel. Prior to installation, with the two protective panels folded against one another in its compact storage configuration, the present invention would be brought in proximity to a similarly sized piece of window or door glass in need of protection. The raised center portion of each long-cord suction cup and short cord suction cup would already be connected to the rear surface of the upper protective panel with one vertically extending flexible tube housing connected between each long-cord and each short-cord suction cup and the rear panel surface. The number of locking-pin suction cups contemplated for attachment of the protective panels to the protected glass would be determined by counting the number of holes through the bottom protective panel. The necessary number of locking-pin suction cups would be then assembled by placing the distal end of one locking pin through a pre-formed central hole in the raised portion of each needed locking-pin suction cup so that most of the locking pin extends beyond the upper surface of the raised portion of the suction cup with only a flange securing the proximal end of the locking pin within the rear concave portion of the suction cup. With the rear surface of the bottom protective panel facing the glass requiring protection and with the upper and bottom protective panels slightly separated from one another, the locking pins would each then be inserted through a different hole in the bottom protective panel so that the locking pins extend beyond the front surface of the bottom protective panel. Each long-cord and short-cord suction cup would have a cord attached on its proximal end to a tongue release depending from the upper edge of the suction cup, as well as a ring attached to the distal end of the cord for ease in releasing the respective suction cup from the protected glass during removal of the present invention from its protective position. The cord of each long-cord and short-cord suction cup would be inserted through the flexible tube housing secured between the raised portion of the respective suction cup and the rear surface of the bottom protective panel so that a downward force exerted on its attached ring would be readily transferred to the tongue release and cause prompt release of the respective suction cup from the protected glass. Spacers of impact absorbing foam, usually in the form of a rectangular block, would also be attached to the rear surface of both top and bottom protective panels in substantially centered positions between adjacent suction cups. Although not critical and not limited thereto, in the preferred bi-folded embodiment it is contemplated for the present invention to have two rows of suction cups and one row of impact-absorbing spacers, with the suction cups adjacent to the hinges in both protective panels being in approximate vertical alignment with one another and the suction cups remote from the hinges in both protective panels being in approximate vertical alignment with one another. It is contemplated for connection of the impact absorbing spacers, the flexible tube housings, and the suction cups to the protective panels to be achieved by any adhesive compound or bonding agent that would provide a secure and lasting attachment of one to the other. Different adhesives or bonding agents could be used on the same protective panel for different purposes when it is advantageous to do so. Although not pertinent to every installation of the present invention, when excess dirt and debris has adhered itself to outside surface of the glass requiring protection, cleaning the glass with soap or detergent prior to installation would provide more secure attachment of the suction cups to the protected glass. This would complete the pre-installation steps required for connection of the present invention to glass needing protection, and actual attachment could then rapidly take place using the steps outlined below.

With the locking-pins positioned within the holes provided for them in the bottom protective panel, the hinged protective panels would be raised so that the bottom protective panel is placed in front of the glass needing protection. The bottom protective panel would be aligned with the protected glass and then pressed against the protected glass to flatten the suction cups and cause them to firmly grip the outside surface of the protected glass. In the alternative, the locking-pin suction cups could be pre-attached to the outside surface of the protected glass in positions measured and marked for alignment with the holes in the bottom panel, so that the bottom panel only need be placed over the distal ends of the locking pins to align it prior to successive upward rotation and connection of each upper panel used. The upper protective panel would then be rotated in an upward direction until the long-cord and short-cord suction cups connected thereto come in contact with the protected glass. The upper protective panel would then be pressed against the glass to flatten each suction cup and cause it to firmly grip the outside surface of the glass. The distal end of each cord and ring attached to each of the long-cord and short-cord suction cups should extend downward a sufficient distance below the next adjacent hinge to permit easy gripping of the ring during release of the suction cups from the protected glass after use. Once the long-cord and short-cord suction cups are firmly attached to the protected glass, a metal locking plate with a central opening therethrough can be placed over the distal end of each locking pin and positioned so that it is in contact with the front surface of the protective panel, after which a separate padlock can be attached through a bore in the distal end of each locking pin to secure the locking plate in place and prevent unauthorized removal.

Removal of the preferred bi-folded embodiment of the present invention begins with the unlocking and removal of the padlock from each locking pin. The metal locking plates are also removed at this time. Then, while upwardly rotating the bottom protective panel and holding it in loose proximity to the upper protective panel, a downward force is applied to each ring extending below the hinge until the force causes release of the gripping suction of the associated long-cord or short-cord suction cup from the protected glass. If the present invention would have more than two protective panels the steps of upward rotation and ring pulling would be repeated until all of the suction cups attached to the topmost protective panel are released. The protective panels would then collectively be drawn away from the protected glass and the locking-pin suction cups which are still attached to the protected glass would be released by pulling laterally on the locking pins or manually lifting the tongue release of each suction cup. The locking-pin suction cups could then each be inserted through one of the holes in the bottom panel and secured with one of the locking plates and one of the padlocks to prevent loss of removable components during periods of non use, or for more compact storage of the protective panels, the locking-pin suction cups, padlocks, and locking pins could be separately stored. Thus the present invention is directly attached to the protected glass and no permanent alteration is made to the window or door frame, nor to any part of the building surrounding the frame. Also, no tools are used in its installation or removal. Its protective panels can be made any size and any configuration needed to allow protection of is the glass in any window or door, including round windows, diamond-shaped windows, as well as ones having a rectangular lower perimeter and an arched or rounded upper perimeter.

The description herein provides preferred embodiments of the present invention but should not be construed as limiting the scope of the window and door glass protecting invention. For example, variations can occur in the size of the protective panels; the size, number, and shape of hand-gripping indentations used as handles; the number of protective panels, suction cups, and impact-absorbing spacers used; the type and width of hinges used; the size of the impact-absorbing spacers used; the type of material from which the protective panels and impact-absorbing spacers are made; the degree of transparency of the protective panels; the selection of suction cups used; the type and length of cords used to release the suction cups; and the size and type of padlock used to secure the locking-pin suction cups, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 6*a* is a front view of a first embodiment of a present invention suction cup having a raised center portion and a tongue release depending upwardly from its top edge.

FIG. 6*b* is a side view of the first embodiment of the present invention suction cup.

FIG. 6*c* is a perspective view of the first embodiment of the present invention suction cup.

FIG. 6*d* is a rear view of the first embodiment of the present invention suction cup.

FIG. 6*e* is a front view of a second embodiment of a present invention suction cup for use with a locking pin and having a raised center portion, a central opening through the raised center portion, and a tongue release depending upwardly from the top edge of the suction cup.

FIG. 6*f* is a side view of the second embodiment of the present invention suction cup having a raised center portion, a locking pin extending centrally through the raised center portion, and a tongue release depending upwardly from the top edge of the suction cup.

FIG. 6*g* is an exploded view of the second embodiment of the present invention suction cup having one tongue release extending beyond its perimeter, a raised center portion, a central opening through the raised center portion, and a locking pin poised for insertion through the opening in the raised center portion.

FIG. 6*h* is a front perspective view of the second embodiment of the present invention suction cup having a raised center portion, a locking pin extending centrally through the raised center portion, a flange connected to the proximal end of the locking pin and positioned underneath the raised center portion, and a tongue release extending upwardly from the top edge of the age suction cup.

FIG. 6*i* is a front perspective view of the first embodiment of the present invention suction cup having a raised center portion, a tongue release extending upwardly from its top edge, and a cord attached to the tongue release with a ring attached to the distal end of the cord.

FIG. 6*j* is a front view of a typical protective locking plate of the present invention having a square configuration, a central opening therethrough, and which is used with a padlock to secure each of the second embodiment suction cups into their usable positions.

FIG. 6*k* is a front view of a typical padlock of the present invention used to secure the locking pin of the second embodiment of the present invention suction cups into its usable position.

FIG. 6*l* is a front view of the first embodiment of the present invention suction cup having a raised center portion, a tongue release extending upwardly from its top edge, a short cord attached centrally to the tongue release, a ring attached to the distal end of the cord, and a portion of the cord length extending through a flexible tube housing.

FIG. 6*m* is a front view of the first embodiment of the present invention suction cup having a raised center portion, a tongue release extending upwardly from its top edge, a long cord attached centrally to the tongue release, a ring attached to the distal end of the cord, and a majority of the cord length extending through a flexible tube housing.

FIG. 11*a* is a front view of a fourth embodiment of the present invention having a panel with a semi-circular configuration for use as a top panel, one hand-gripping indentation in its front surface, and two short-cord suction cups attached to its rear surface.

FIG. 11*b* is a perspective view of the first embodiment of the present invention suction cup having a raised center portion, a tongue release extending upwardly from its top edge, a short cord attached centrally to the tongue release, a ring attached to the distal end of the cord, and a portion of the cord length extending through a flexible tube housing.

DETAILED DESCRIPTION OF PREFERRED EMBODIMENTS

The present invention encompasses a multitude of embodiments configured for protecting different sizes and shapes of window and door glass, the embodiments differing in the number of protective panels used, the sizes of the panels used, the perimeter configuration of the panels used, the number of suction cups attached to each of the protective panels used, the number of impact-absorbing spacers attached to the panels centrally between its suction cups, and the differing combinations of long-cord, short-cord, and locking-pin suction cups used for fastening the protective panels to the outside surface of window or door glass. Also, although the most preferred embodiment of the present invention has a bi-fold configuration, it is considered within the scope of the present invention to have more than two connected panels with the top and bottom edges of adjacent panels being hinged together. Ease of use is also an important consideration in the present invention and it is contemplated that the size and weight of the present invention be limited so that under most routine conditions one or two people of ordinary strength and coordination can rapidly install and remove it. For simplicity, the following detailed description will focus on the application of the present invention to the protection of window glass in commercial buildings, however, it should be considered equally feasible and within the scope of the present invention for all of the following to also apply to residential window glass, exterior sliding glass doors or wall panels having two or more sliding frames in association with one another (not shown) and other types of doors made substantially from glass.

Figure 1:
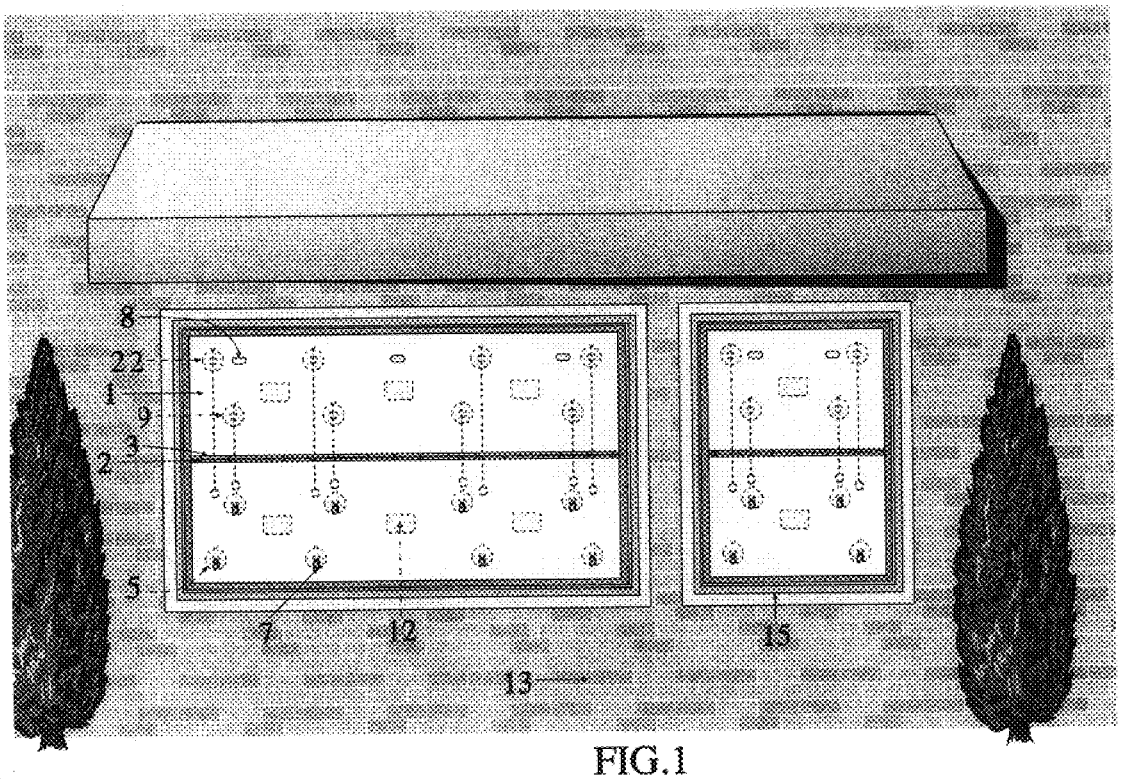
FIG. 1 is a front view of first and second embodiments of the present invention with the first embodiment installed over and protecting a large piece of window glass and the second embodiment protecting the glass in a window having a smaller width dimension.

FIG. 1 shows a building wall 13 with two window frames 15 positioned adjacent to one another, both window frames 15 having an identical height dimension but the left-positioned window frame 15 having a larger width dimension than the right-positioned one. FIG. 1 also shows a first preferred embodiment of the present invention protecting the window glass, identified in FIG. 10 by the number 14, in the left-positioned window frame 15, and a second preferred embodiment of the present invention protecting the window glass 14 in the right positioned window frame 15. For clarity of illustration the numbering of components in FIG. 1 is mainly limited to the larger, left-positioned first embodiment. The present invention in each embodiment shown in FIG. 1 has two protective panels 1 of nearly identical size and one horizontally extending hinge 3 which is connected between the two panels 1 and extends substantially across their full width. In the alternative, although not most preferred, several hinges 3 could be used to connect adjacent panels 1 together. Also, hinges 3 having different configurations could be used. Hinge fasteners 2 attach hinge 3 to the front surfaces of panels 1 so that their joined top and bottom edges pivot 180° relative to one another from an opened flat configuration to a folded configuration where both panels 1 are approximately parallel to one another. The panels 1 in each preferred embodiment are configured and dimensioned to completely cover window glass 14 so as to protect it from breakage by airborne storm debris (not shown) as well as from acts of vandalism and unauthorized entry, and to protect the building interior (not shown) from wind and water damage that would otherwise occur if window glass 14 were broken. Panels 1 may either be transparent or translucent to allow outside light (not shown) to pass through window glass 14, or in the alternative one or more panels 1 in each present invention may be opaque to conceal all or part of the building's interior (not shown) from outside view. Although not shown, panels 1 can be made from tinted or colored materials, and panels 1 can also contain decorative markings to include advertising indicia and company logos.

Figure 3:
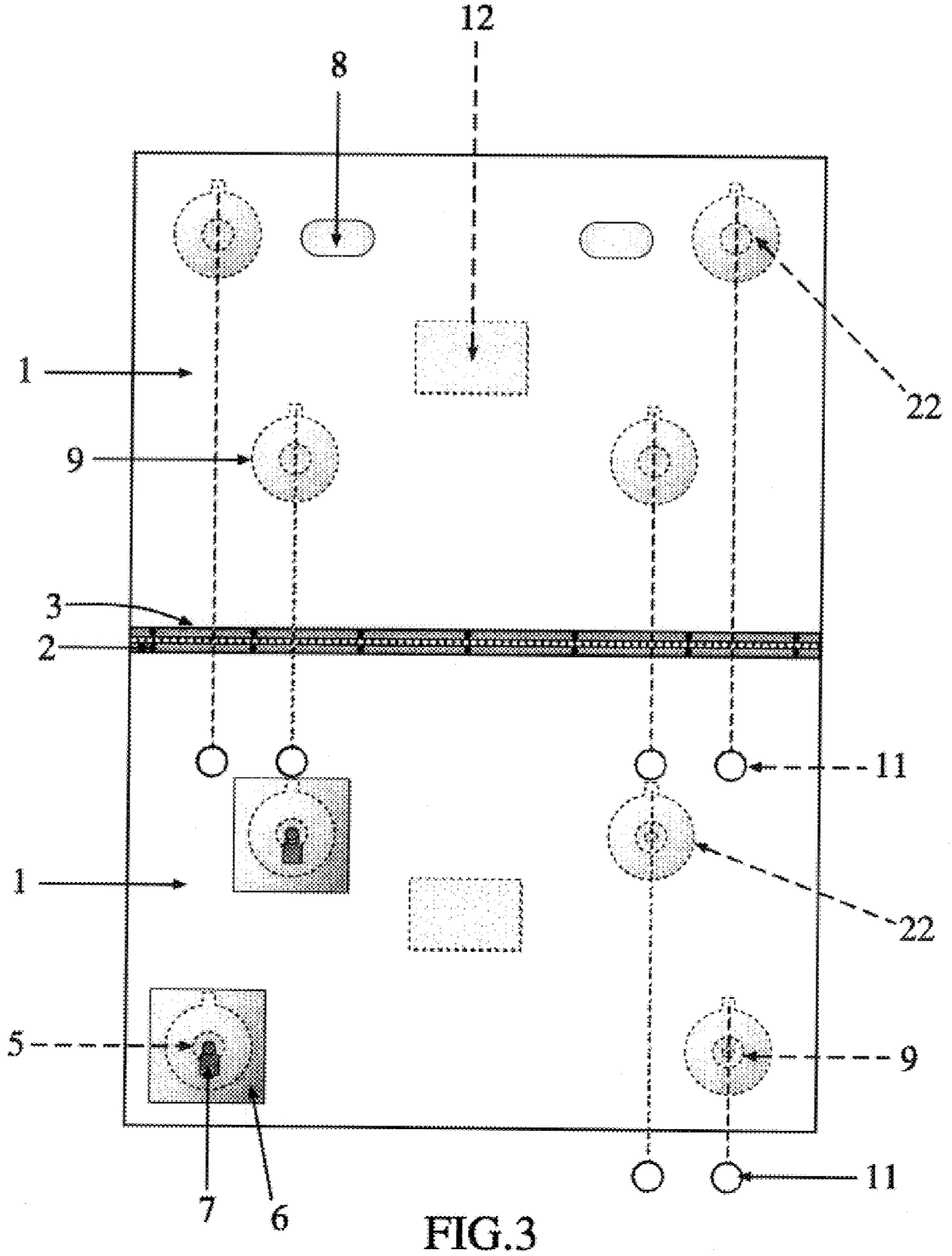
FIG. 3 is a front view of a third embodiment of the present invention having three long-cord suction cups attached to its rear surface, two near to the top edge of the upper panel and one near to the top edge of the lower panel; three short-cord suction cups attached to its rear surface with two of the short-cord suction cups attached to the upper panel centrally between the long-cord suction cups and the hinge, but vertically off-set from the two long-cord suction cups, and the third short-cord suction cup attached near to the bottom edge of the lower panel, vertically off-set from the adjacent long-cord suction cup but vertically aligned with one of the long-cord suction cups on the upper panel, two locking-pin suction cups which are positioned behind the lower panel and placed in positions horizontally aligned with the long-cord and short-cord suction cups to be used for securing the lower panel to the protected glass; one spacer block of impact-absorbing foam attached to the back surface of both the upper and lower protective panels centrally between adjacent suction cups, two spaced-apart hand-gripping indentations in the upper panel near to its top edge, and a ring hanging downwardly from each of the distal ends of the cords attached to the long-cord and short-cord suction cups and extending beyond the lower edge of the panel to which its associated suction cup is connected.

In addition, FIG. 1 shows the uppermost protective panels 1 in both embodiments having several hand-gripping indentations formed therein that are used during installation and removal of the panels as handles 8 for ease in manipulating the present invention. In FIG. 1 the first preferred embodiment is shown with three spaced-apart handles 8 and the second preferred embodiment is shown with two spaced-apart handles 8. The handles 8 in the first preferred embodiment span substantially across the width of upper panel 1. The handles 8 in both embodiments are positioned near to the upper edge of the uppermost panels 1 on their outside surfaces. Handles 8 should be sufficiently large for convenient insertion of at least two or three adult fingers, but not have an unnecessarily large width or depth dimension that would weaken the structural integrity of upper panels 1. Handles 8 could also be formed laterally on the front surface, or on the rear surface of lower panels 1 to assist manipulation of panels 1 in exposing rings 11 for release of long-cord suction cups 22 and short-cord suction cups 9. FIG. 1 further shows several long-cord suction cups 22 positioned near to the upper edge of the uppermost panels 1 in both embodiments, and several short-cord suction cups 9 positioned centrally between the long-cord suction cups 22 and hinge 3, but off-set vertically from the long-cord suction cups 22. Rings identified by the number 11 in FIG. 3 are attached to each long-cord suction cup 22 and each short-cord suction cup 9. Rings 11 must extend below hinge 3 so that during removal of the present invention from window frame 15 access to rings 11 is made possible by an upward lifting of the lower panels 1. Once access is achieved, each ring 11 is pulled to release its associated long-cord suction cup 22 or short-cord suction cup 9 so that the uppermost panels 1 can be easily lifted away from protected window glass 14. Between uses, hinge 3 permits folding of the present invention into a more compact configuration for storage.

FIG. 1 further shows a first row of several locking-pin suction cups 5 positioned near to the lower edge of the lowermost panels 1 in the first and second embodiments, as well as a second row of locking-pin suction cups 5 positioned centrally between the first row of locking-pin suction cups 5 and hinge 3, but off-set vertically from the locking-pin suction cups 5 in the first row. Although placement is not restricted thereto, FIG. 1 shows one long-cord suction cup 22 in upper panel 1 being vertically aligned with each locking-pin suction cup 5 in the first row on lower panel 1, and one short-cord suction cup 9 in upper panel 1 positioned above each locking-pin suction cup 5 in the second row on lower panel 1. A padlock 7 is connected to each locking-pin suction cup 5 to prevent unauthorized removal of connected upper and lower panels 1. The number of locking-pin suction cups 5 used is not It critical to the present invention. However, it is contemplated that at least one locking-pin suction cup 5 would be included as a part of each embodiment of the present invention used where unauthorized removal was a concern. Also, locking-pin suction cups 5 are not restricted to use with bottom panel 1, although it is more convenient to do so for those installing and removing padlocks 7, and it is also within the scope of the present invention to have an embodiment only with locking-pin suction cups 5 on both upper and lower panels 1. As it is more clearly shown in FIGS. 2 and 3, in the second preferred embodiment a locking pin centrally depends from the convex front surface of each locking-pin suction cup during use and becomes inserted through one of the holes 21 in the lowermost panel 1 to extend beyond the front surface thereof where a padlock 7 connected to the distal end of locking pin 19 will secure the lowermost panel 1 against the protected glass 14. FIG. 1 also shows several block-shaped pieces of impact-absorbing foam 12 centrally connected to the uppermost panel 1 in a horizontal row between the horizontal rows of long-cord suction cups 22 and short-cord suction cups 9 and several pieces of impact-absorbing foam 12 centrally connected to the lowermost panel 1 in a horizontal row between the first and second horizontal rows of locking-pin suction cups 5. Impact-absorbing foam 12 also is approximately centrally positioned between adjacent long-cord suction cups 22 and short-cord suction cups 9. Impact-absorbing foam 12 functions as a spacer to maintain the back surface of panels 1 at the correct distance from window glass 14 to permit easy and rapid release of long-cord suction cups 22 and short-cord suction cups 9 from protected window glass 14 upon demand, and to provide strong unimpeded attachment of long-cord suction cups 22 and short-cord suction cups 9 to the protected glass 14. Although FIG. 1 shows the pieces of impact-absorbing foam 12 attached to the uppermost panel 1 in each embodiment positioned directly above pieces of impact-absorbing foam 12 attached to lowermost panel 1, such positioning is not critical and would not occur unless the pattern made by long-cord suction cups 22 and short-cord suction cups 9 attached to the uppermost panel 1 is the mirror image of the pattern made by the locking-pin suction cups 5 attached to the lower panels 1. However, it is contemplated that a piece of impact-absorbing foam 12 will be positioned centrally between long-cord suction cups 22, short-cord suction cups 9, and locking-pin suction cups 5 positioned adjacent to one another on the same panel 1. At a minimum, impact-absorbing foam 12 should have at least one flat or otherwise configured side for secure attachment of impact-absorbing foam 12 to the rear surface of the panel 1 for which it provides its impact-absorbing function.

The protective panels 1 would each be made from a durable, shatter-resistant material, such as but not limited to LEXAN, to provide an appropriate balance of lightweight material that also has good abrasion resistance and impact strength. In addition to being made from transparent, translucent, and opaque materials, protective panels 1 may contain surface decoration, including advertising messages and company logos (not shown), depending upon the user's preference or need. In locations where extended periods of violent storm activity are predictable, such as hurricanes, typhoons, and tornadoes, transparent protective panels 1 could be installed prior to the beginning of the predicted storm season and left in place for its duration since transparent protective panels 1 would not significantly diminish incoming light, since they would not detract from the aesthetic appearance of a building, and to be certain that they are in place when needed upon short notice. In installing protective panels 1 over window and door glass 14, it is important to consider whether such installation interferes with the opening of the window or door glass 14 and whether the window or door glass 14 is relied upon for emergency egress. For example, installation of protective panels 1 over the front glass 14 in a pair of sliding doors (not shown) would not interfere with its operation, however, installation of the protective panels 1 over the rear glass 14 in sliding glass doors would make the combination panel 1 and glass 14 too thick to move behind the front glass 14. Thus, since protective panels 1 would substantially cover door glass 14, neither sliding door in the pair would be able to move with respect to the other. To protect larger commercial window glass 14 with the present invention, it is contemplated that two or more people may be required to install protective panels 1, however for the protection of smaller window glass 14 installation of protective panels 1 may be accomplished by only one or two people of average strength and coordination depending upon the wind conditions and the height of the window glass 14 intended for protection. Using a ladder or a lift (not shown), the present invention could also be installed over upper story window glass 14 for protection thereof against the hazards of storm debris, vandalism, and unauthorized entry. Bulletproof materials (not shown) can further enhance the protective function of any embodiment of the present invention. When not in use, hinges 3 allow the present invention to be folded into a compact configuration so that it can be easily stored. The present invention can be manufactured in several standard sizes or it can be custom-fit for protection of non-standard sizes of window glass 14. The protective panels 1 would also provide a thermally insulating outer layer for the glass 14 in windows and doors, and should panel 1 be given a one-way thermal transfer capability, it could either add heat to a room in a cold climate or keep afternoon sunlight from excessively heating a room in a warm climate. Further, since the present invention is simple in design, it could be cost effectively manufactured for widespread use among cost conscious business owners.

Figure 2:
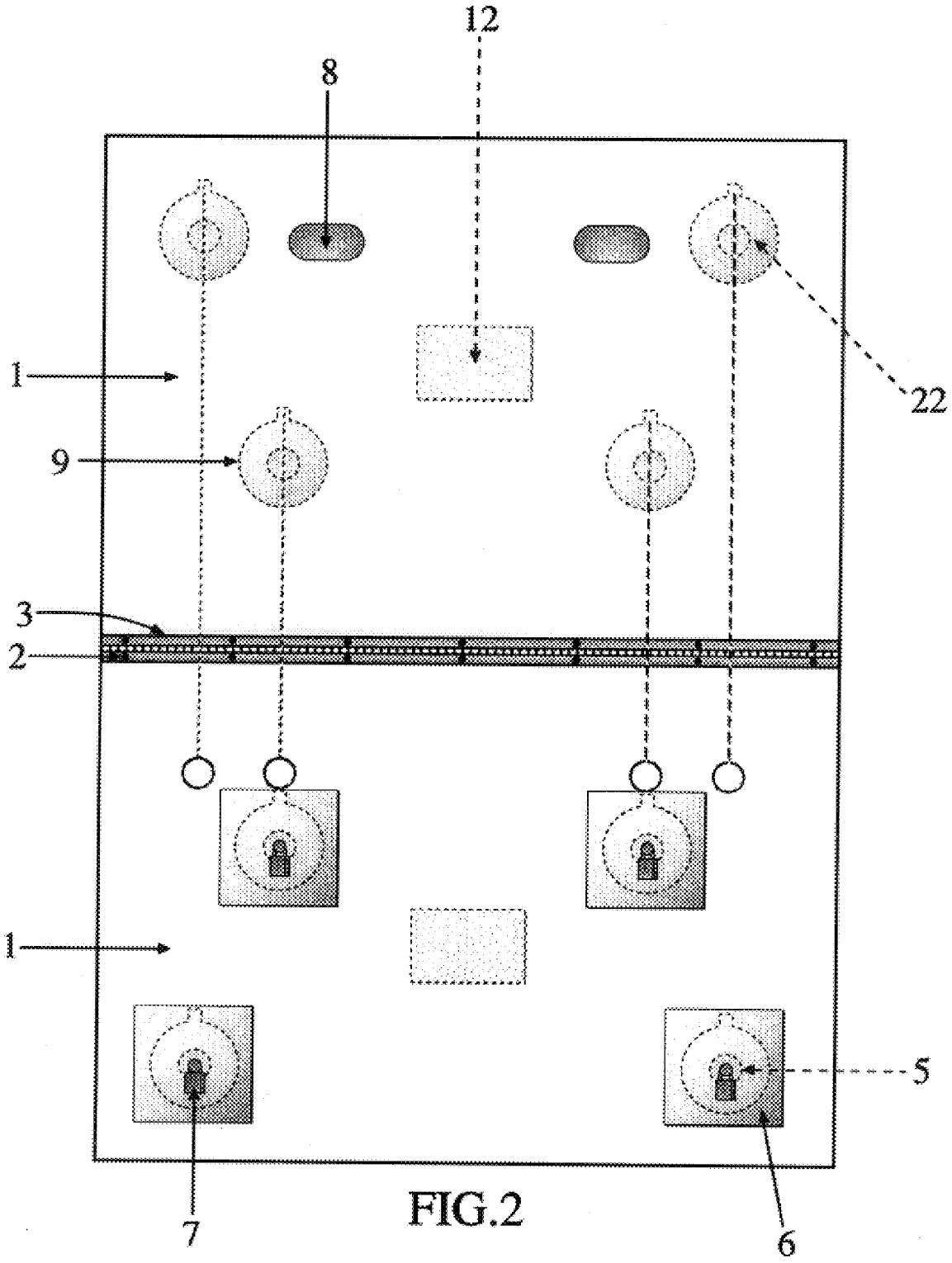
FIG. 2 is an enlarged front view of the second embodiment of the present invention having upper and lower protective panels of substantially similar dimension and configuration connected together by a horizontally extending hinge connected the full width of the panels, two long-cord suction cups attached to the rear surface and near to the top edge of the upper panel, two short-cord suction cups attached to the rear surface of the upper panel centrally between the long-cord suction cups and the hinge but vertically off-set from the long-cord suction cups, four locking-pin suction cups positioned behind the lower panel, one spacer block of impact-absorbing foam attached to the back surface of both the upper and lower protective panels centrally between adjacent suction cups, two hand-gripping indentations in front surface of the upper panel near to its top edge, and a ring hanging downwardly below the a hinge from each of the distal ends of the cords attached to the long-cord and short-cord suction cups.

FIG. 2 shows the second embodiment of the present invention having upper and lower protective panels 1 connected together by one horizontally extending hinge 3 that substantially spans the full width of panels 1, two long-cord suction cups 22 attached to the rear surface and near to the top edge of upper panel 1, and two short-cord suction cups 9 attached to the rear surface of upper panel 1 centrally between long-cord suction cups 22 and hinge 3, and vertically off-set from long-cord suction cups 22. The use of a piano type of hinge for hinge 3 is preferred since it also provides a continuous weather-resistant and tamper-resistant seal between upper and lower panels 1, however other types of hinge connection may also be used as long as each provides a sturdy connection between panels 1 that allows panels 1 to fulfill their security function. Hinge fasteners, shown as number 2 in FIG. 2, should not be easily Of releasable from the front of panels 1 to minimize the possibility of unauthorized removal. In addition FIG. 2 shows four locking-pin suction cups 5 positioned behind lower panel 1, a spacer block of impact-absorbing foam 12 attached centrally to the back surface of both upper and lower protective panels 1, and also centrally between adjacent locking-pin suction cups 5, as well as two hand-gripping indentations in upper panel 1 near to its top edge for use as handles 8 to assist manipulation of panels 1. Each locking-pin suction cup 5 has a rigid locking plate 6 aligned with it and positioned against the front surface of lower panel 1. In the preferred embodiment, locking plate 6 would be made from a strong, non-corroding metallic material, such as stainless steel. A padlock 7 is also connected through a bore or slot in the distal end of each locking-pin suction cup 5 to secure locking plate 6 against the front surface of lower panel 1. It is contemplated that each metal locking plate 6 and each padlock 7 at a minimum be made from weather-resistant materials, or be provided with an outer coating of material which enhances its resistance to weathering elements over an extended period of time. Although impact-absorbing foam 12 is shown in FIG. 2 to have a rectangular cross-sectional configuration, its shape is not critical and it is contemplated for impact-absorbing foam 12 to have any type of perimeter configuration, such as that of a circle, or any regular or irregular polygon. Also, although FIG. 2 shows handles 8 horizontally aligned with one another and further horizontally aligned with the suction cup 4 portion of long-cord suction cups 22, such alignment is not critical. FIG. 2 further shows hinge fasteners 2 evenly spaced across hinge 3 for use in attaching hinge 3 to both upper and lower panels 1. A sufficient number and placement of hinge fasteners 2 through both pivoting strips of hinge 3 is needed to securely attach hinge 3 to panels 1. However, even spacing of hinge fasteners 2 is not critical. Also, hinge fasteners 2 could include any type of fastener which is not easily released from the front side of panels 1 and which does not have a large rear component that could interfere with the pulling of cords 23 during release of long-cord suctions cups 22 and short-cord suction cups 9 from the protected glass 14. One ring, identified by the number 11 in FIG. hangs downwardly below hinge 3 from the distal end of each cord, identified by the number 23 in FIG. 4*a*, that is attached to a long-cord suction cup 22 or a short-cord suction cup 9. Although rings 11 make it easier for one to grasp the distal ends of cords 23 and the addition of extra weight to the distal ends of cords 23 makes them hang in a more vertical position, the use of rings 11 is not critical to the present invention. Also, although they would be used for guiding the vertical movement of cords 23 during release of suction cups 4 from the protected glass 14, for simplicity of illustration in FIG. 2 the flexible tube housings, shown in FIG. 4*a* and identified by the number 10, have been omitted from FIG. 2. The other end of each cord 23 is attached to a tongue release, identified by the number 18 in FIG. 6*a*, vertically extending beyond the upper perimeter of either a long-cord suction cup 22 or a short-cord suction cup 9 that provides a means of releasing the suction grip of long-cord suction cups 22 and short-cord suction cups 9 to the protected glass 14 when use of the present invention is no longer needed. Also, cords 23 are not limited to the lengths shown in FIG. 2.

FIG. 3 shows a third embodiment of the present invention in its usable position and having an upper panel 1 connected to a lower panel 1 by hinge 3 which extends horizontally across substantially the full width of both panels 1. FIG. 3 also shows both panels 1 having the same perimeter configuration and approximately the same dimension. However, the configuration and dimension of panels 1 are not critical and it is equally contemplated that the semi-circular panel shown as number 17 in FIG. 11 a be used in place of one panel 1 or both panels 1, or for embodiments of the present invention to have other panels with configurations and sizes not shown in FIGS. 1–11, such as triangular-shaped where two connected panels would make a protective device for a diamond shaped piece of window glass 14. It is only critical that each panel 1, panel 17, or other panel used have one flat side for hinged connection to another panel also having at least one flat side and that the combination of panels used substantially approximates the dimension and configuration of the window glass 14 to be protected. FIG. 3 shows upper panel 1 having two hand-gripping indentations for use as handles 8 which are spaced apart from one another and located near to the top edge of upper panel 1. Handles 8 at a minimum should have sufficient width and depth dimension to permit the comfortable insertion of two to three adult fingers (not shown), but handles 8 should not be so large that they compromise the structural integrity of upper panel 1. Although not shown, it is also contemplated for handles 8 to be placed elsewhere on upper panels 1 and 17, as well as on the front and rear surfaces of lower panel 1. FIG. 3 further shows the present invention having three long-cord suction cups 22 and three short-cord suction cups 9 attached to the rear surface of upper and lower panels 1. Two long-cord suction cups 22 are laterally connected to upper panel 1 near to its top edge. Both long-cord suction cups 22 connected to upper panel 1 are also each aligned with handles 8, each also being centrally positioned between one handle 8 and the side edge of upper panel 1. Two short-cord suction cups 9 are also connected to upper panel 1, with one being positioned centrally within the left half of upper panel 1 and the other short-cord suction cup 9 being positioned centrally within the right half of upper panel 1. In FIG. 3 the two short-cord suction cups 9 are also off-set centrally and vertically from the two long-cord suction cups 22 attached to upper panel 1. The third long-cord suction cup 22 is vertically aligned with one of the short-cord suction cups 9 attached to upper panel 1 and connected to the upper portion of lower panel 1 in a position below the ring 11 of the short-cord suction cup 9 directly above it. The third short-cord suction cup 9 is attached to the same side of lower panel 1 as the third long-cord suction cup 22. The third short-cord suction cup 9 is also vertically aligned with one of the long-cord suction cups 22 attached to upper panel 1 and connected to lower panel 1 near to its bottom edge as well as in proximity to one of its side edges. FIG. 3 shows all rings 11 extending below hinge 3 to be approximately horizontally aligned with one another behind lower panel 1. Although rings 11 should extend below hinge 3, horizontal alignment thereof is not critical. The two rings 11 extending below the bottom edge of lower panel 1 are also approximately horizontally aligned with one another, although such alignment is also not critical. The rings 11 extending below lower panel 1 need only be positioned at a distance below lower panel 1 which allows easy grasping thereof and rapid release of each connected long-cord suction cup 22 and each short-cord suction cup 9 from protected glass 14. FIG. 3 also shows two locking-pin suction cups 5 positioned behind lower panel 1 each on the same side of lower panel 1 in positions laterally opposed to the third long-cord suction cup 22 and the third short-cord suction cup 9, respectively. The upper locking-pin suction cup 5 is vertically aligned with one of the short-cord suction cups 9 attached to upper panel 1 and connected to the upper portion of lower panel 1 in a position below the ring 11 of the short-cord suction cup 9 directly above it. The lower locking-pin suction cup 5 is vertically aligned with one of the long-cord suction cups 22 attached to upper panel 1 and connected to lower panel 1 near to its bottom edge as well as in proximity to one of its side edges. FIG. 3 shows both locking-pin suction cups 5 having a locking plate 6 centered over it and positioned against the front surface of lower panel 1, with a padlock 7 connected to the locking-pin suction cup 5 in front of locking plate 6. FIG. 3 also shows a rectangular spacer block of impact-absorbing foam 12 positioned centrally behind both upper and lower protective panels 1 and centrally between adjacent suction cups 4, as well as two hand-gripping indentations for use as handles 8 formed into the front surface upper panel 1 near to its top edge. Although impact-absorbing foam 12 is shown in FIG. 3 to have a rectangular shape, it is considered within the scope of the present invention for impact-absorbing foam 12 to have any perimeter configuration when viewed through panels 1 that are transparent. For simplicity of illustration the flexible tube housings, shown in FIG. 4*a* and identified by the number 10, have been omitted from FIG. 3, leaving only an unnumbered general representation of an attachment means between each ring 11 and a tongue release, shown as number 18 in FIG. 6*a*, which upwardly depends from the top perimeter of each long-cord suction cup 22 and the top perimeter of each short-cord suction cup 9. Also, although FIG. 3 shows three long-cord suction cups 22, three short-cord suction cups 9, and two locking-pin suction cups 5 aligned with each other in a particular spatial configuration, the number of long-cord suction cups 22, short-cord suction cups 9, and locking-pin suction cups 5 used is not critical, nor is their spatial configuration relative to one another critical as long as in combination they securely us attach panels 1 to the protected window glass 14 shown in FIG. 8, and as long as the rings 11 and cords 23 are positioned for unobstructed use in releasing the gripping type of suction connection of the present invention to the window glass 14 it protects. The number and positioning of handles 8 are also not critical, as long as they are conveniently located for optimum ease in manipulation of upper panel 1. FIG. 3 further shows hinge fasteners 2 evenly spaced across hinge 3 for use in attaching hinge 3 to both upper and lower panels 1. The number of hinge fasteners 2 can be variable and would depend in part upon their size and configuration, as well as the thickness of the panels 1 to which they are attached.

Figure 4A:
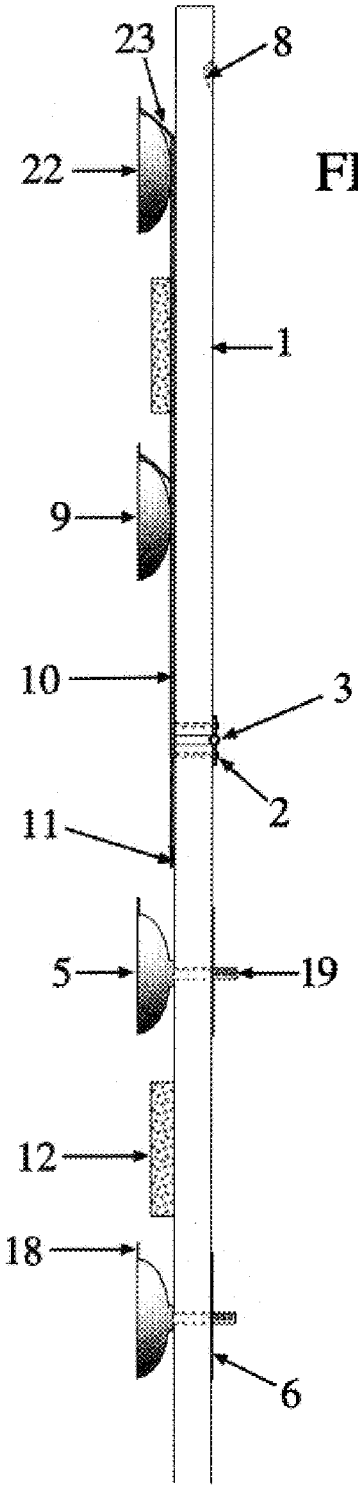
FIG. 4*a* is a side view of the present invention in its upright and essentially planar installed configuration.
Figure 4B:
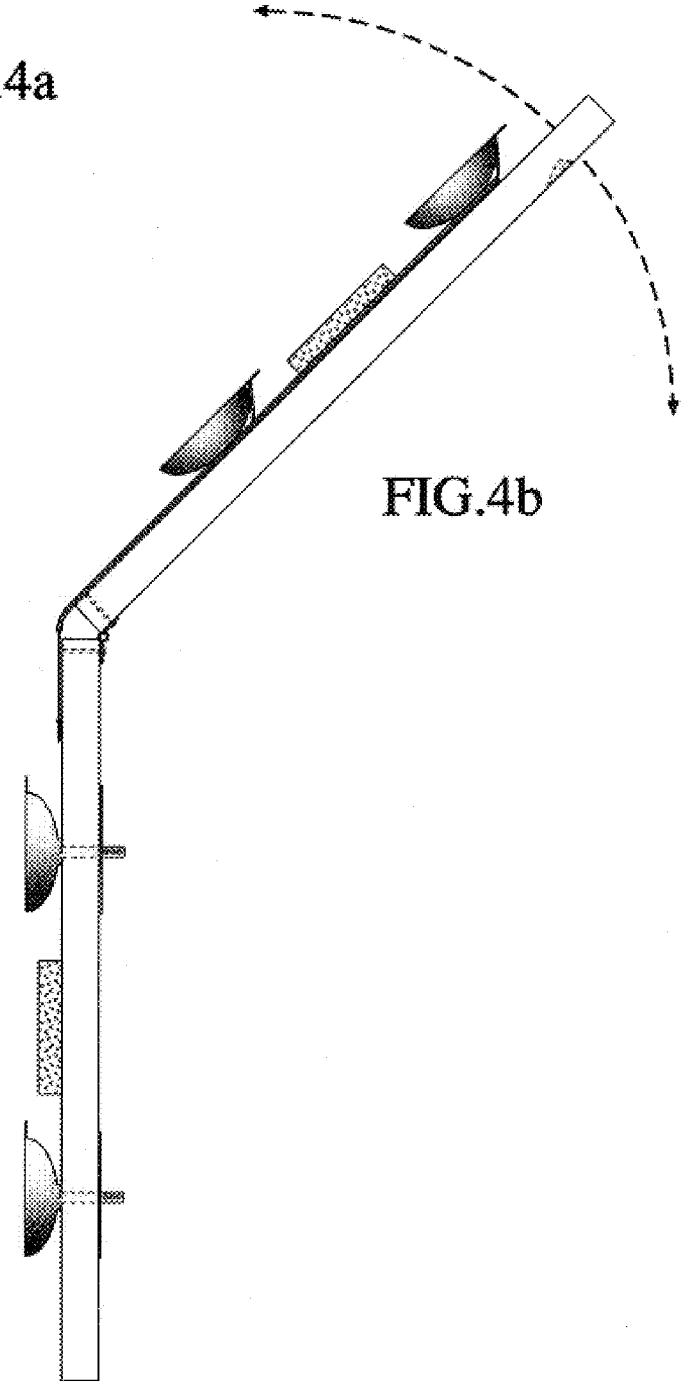
FIG. 4*b* is a side view of the present invention with its upper panel at an oblique angle relative to its lower panel and arrows showing the direction of movement of the upper panel during installation and removal from its position in front of protected glass.
Figure 8:
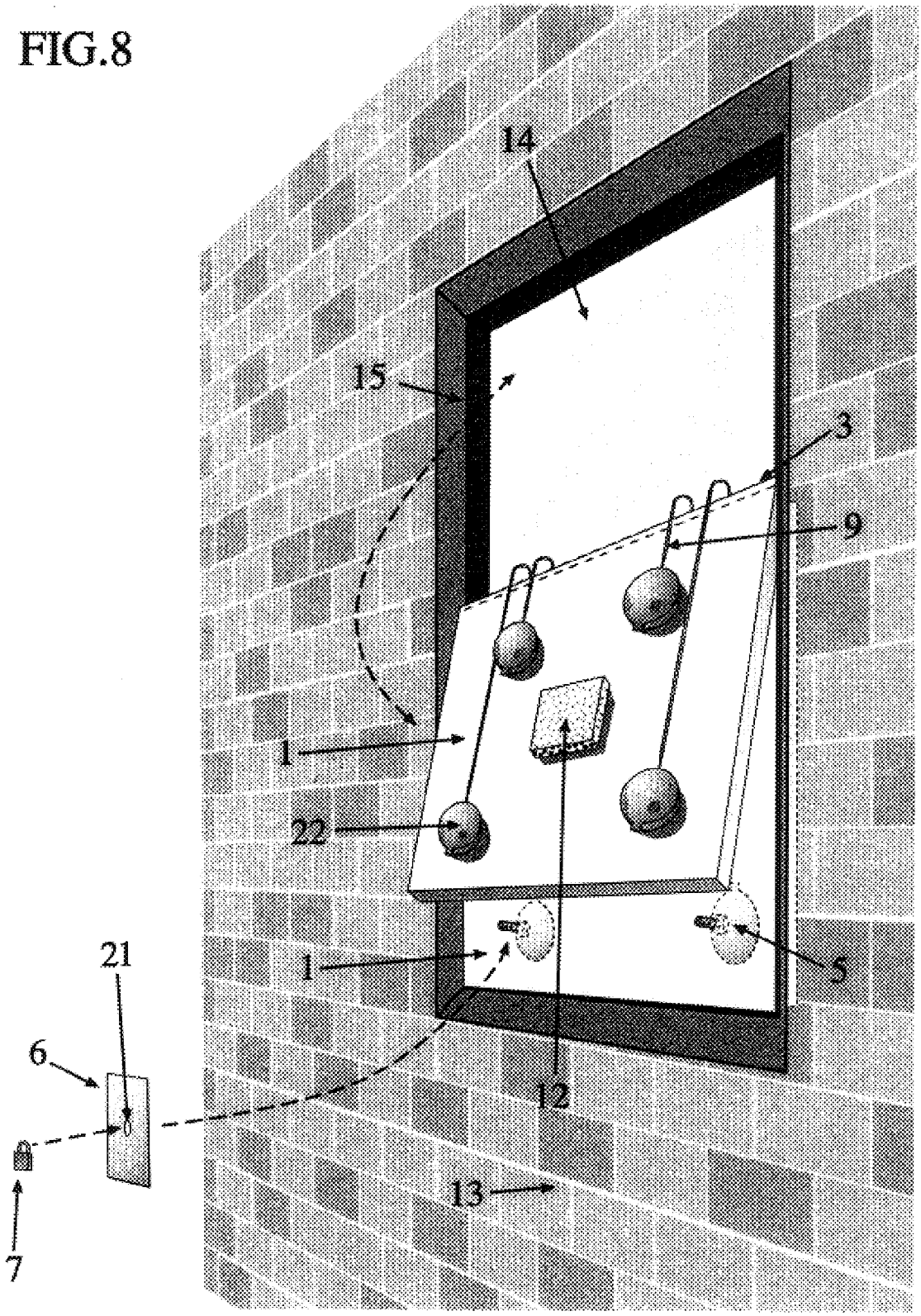
FIG. 8 is a perspective view of the second embodiment of the present invention during the initial stages of installation with its locking-pin suction cups attached to the protected glass, the lower protective panel positioned over the locking pins of the attached locking-pin suction cups, and arrows showing subsequent steps of rotating the upper protective panel upward, inserting the locking plate over the locking pin, and connecting a padlock to the distal end of the locking pin to secure the lower panel against unauthorized removal.

FIGS. 4*a* shows the present invention in its upright and essentially planar installed orientation, while FIG. 4*b* shows upper panel 1 at an oblique angle relative to lower panel 1, a position taken by the present invention during its installation or removal from protected window glass, shown in FIG. 8 as number 14. Arrows in FIG. 4*b* show the direction of movement of upper panel 1 relative to lower panel 1, although during removal of the present invention from protected window glass 14, lower panel 1 would also be moved relative to upper panel 1. FIGS. 4*a* and 4*b* show a hinge 3 connected between two panels 1 and attached to the front surfaces of the two panels 1 by hinge fasteners 2. The size, number, and configuration of hinge fasteners 2 used is not critical to the present invention, however, hinge fasteners 2 must not have a large rear component that would injure a person transporting or installing panels 1, or which might interfere with the suction release accomplished by cords 23 attached to long-cord suction cups 22 and short-cord suction cups 9. FIGS. 4*a* and 4*b* also show an angled gripping indentation in the upper front surface of upper panel 1 for use as a handle 8. Handle 8 is positioned slightly above long-cord suction cup 22, however, handles 8 can be placed in any location which optimizes handling of upper panel 1 during its installation and removal from protected window glass 14. The size, configuration, and number of handles are not critical as long as they are sufficiently large for convenient use but not so large that they weaken the structural integrity of upper panel 1. FIGS. 4*a* and 4*b* further show impact-absorbing foam 12 centrally attached to the rear surface of both panels 1, and centrally attached between long-cord suction cups 22 and short-cord suction cups 9, as well as adjacent locking-pin suction cups 5. Although the means of connection of impact-absorbing foam 12 to panels 1 is not shown, it is contemplated for any type of adhesive or bonding agent to be used which securely and permanently attaches the spacer blocks of impact-absorbing foam 12 to panels 1. FIGS. 4*a* and 4*b* show long-cord suction cup 22 attached to a flexible tube housing 10 that extends downwardly at least to the lower edge of hinge 3. Although not shown in either FIG. 4*a* or 4*b*, short-cord suction cup 9 would also be attached to a flexible tube housing 10 that downwardly extends to at least the lower edge of hinge 3. The flexible tube housings 10 would be attached to upper panel 1 and the raised portion 24 of suction cup 4 shown in FIG. 5 by any adhesive or bonding agent that would securely and permanently attach flexible tube housing 10 to upper panel 1. The adhesive or bonding agent could be the same or different from that used to attach the spacer blocks of impact-absorbing foam 12 to panels 1. During installation and removal of the present invention from protected window glass 14, FIG. 4*b* shows the lower end of flexible tube housing 10 extending across the gap created between upper panel 1 and lower panel 1. FIGS. 4*a* and 4*b* show cord 23 extending from the upper edge of long-cord suction cup 22, through flexible tube housing 10, and below the lower end of flexible tube housing IO to support ring II. FIGS. 4*a* and 4*b* show two locking-pin suction cups 5 connected to lower panel 1, one above the spacer block of impact-absorbing foam 12 and the other below impact-absorbing foam 12. Both locking-pin suction cups 5 have a locking pin 19 extending through lower panel 1 and beyond the front surface of lower panel 1, as well as a locking plate 6 positioned against the front surface of lower panel a centrally around each locking pin 19. Although not shown, in FIGS. 4*a* and 4*b*, a padlock 7 would be connected to one of the bores in the distal end of locking pin 19 to securely position locking pin 6 against the front surface of lower panel 1.

Figure 5:
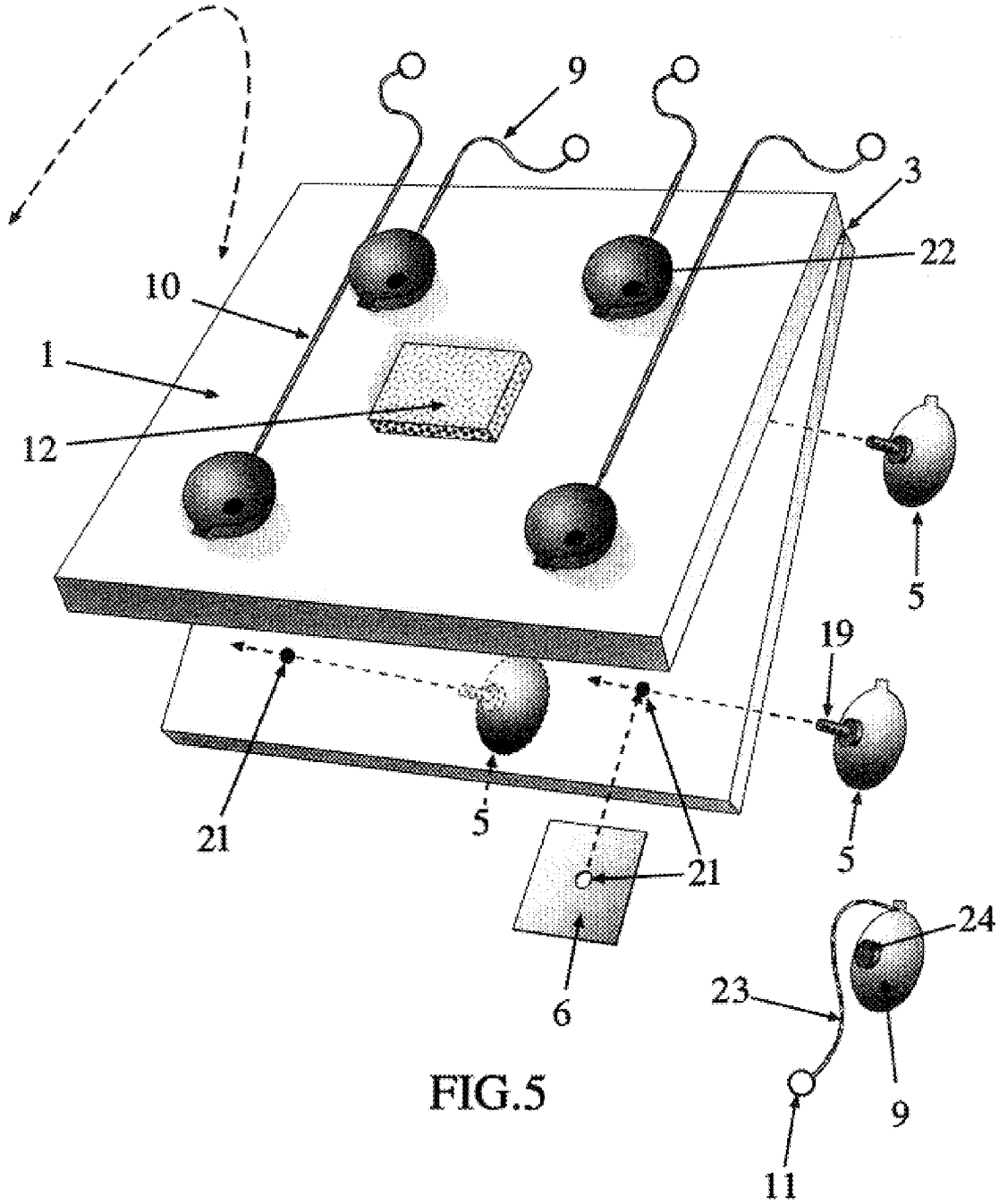
FIG. 5 is a perspective view of the present invention in a nearly folded configuration with two long-cord and two short-cord suction cups attached to the rear surface of its upper panel, also with several locking-pin suction cups positioned for connection to its lower panel, as well as one additional short-cord suction cup which could also be substituted for one of the locking-pin suction cups.

FIG. 5 shows the present invention having two panels 1 in a nearly folded configuration with two long-cord suction cups 22 and two short-cord suction cups 9 attached to the rear surface of its upper panel 1. A hinge 3 connects upper panel 1 to lower panel 1, and a spacer block of impact-absorbing foam 12 is centrally attached to the rear surface of upper panel 1. An arrow shows the direction of folding and unfolding of upper panel 1 relative to lower panel 1. Although not shown, it is contemplated that a spacer block of impact-absorbing foam 12 would be similarly attached to the rear surface of lower panel 1. Long-cord suction cups 22 and short-cord suction cups 9 are connected to upper panel 1 so that their concave surfaces are facing away from upper panel 1. Also, in order to clearly show that a cord 23 extends from the top edge of each long-cord suction cup 22 and each short-cord suction cup 9, through flexible tube housings 10, and beyond the lower ends of flexible tube housings 10, the flexible tube housings 10 have been shortened in FIG. 5 for illustrative purposes. To be fully functional in guiding one of the cords 23 for prompt suction release of a long-cord suction cup 22 or a short-cord suction cup 9 from protected window glass 14, all of the flexible tube housings 10 would need to extend from a position near to the upper edge of each long-cord suction cup 22 and each short-cord suction cup 9 to a position beyond the bottom edge of upper panel 1. FIG. 5 also shows the front of a non-attached short-cord suction cup 9 having a cord 23 connected between the upper edge of the short-cord suction cup 9 and a ring 11, and which would be connected to upper or lower panel 1, but would need a flexible tube housing 10 when attached to panel 1 to guide cord 23 when it is pulled to release gripping attachment of the short-cord suction cup 9 from protected glass 14. FIG. 5 further shows short-cord suction cup 9 having a raised center portion 24 which would be connected to upper panel 1 with flexible tube housing 10 positioned therebetween. In addition, FIG. 5 shows three locking-pin suction cups 5 poised behind lower panel 1 with locking pins 19 each aligned with a hole 21 in lower panel 1 for insertion therethrough. Although not shown, it is contemplated that a fourth locking-pin suction cup 5 could be connected to lower panel 1 in a similar manner. Once the distal ends of locking pins 19 extend beyond the front surface of lower panel 1, each locking pin 19 is also inserted through a central hole 21 in a locking plate 6. Although not shown in FIG. 5 but shown in other figures such as FIG. 3, locking pins 19 are each further connected to a padlock 7 that secure panels 1 in place against protected window glass 14. Handles 8 are not shown in FIG. 5 since they are positioned in the front surface of upper panel 1 which is not readily visible to a viewer.

FIGS. 6*a*–6*m* show views of three alternative embodiments of the suction cups used in the present invention, the long-cord suction cups 22, the short-cord suction cups 9, and the locking-pin suction cups 5, as well as locking plate 6 and padlock 7 which attach over the distal end of the locking-pin suction cup 5 embodiment. FIGS. 6*a*–6*d* show a first embodiment of a present invention suction cup 4 having opposed convex and concave surfaces, a raised center portion 24 extending beyond its convex surface, and a tongue release 18 extending upwardly from the top edge of its convex surface. The first embodiment of suction cup 4 would be used to construct long-cord suction cups 22 and short-cord suction cups 9. FIG. 6*a* shows a front view of the convex surface of the first embodiment, while FIG. 6*b* shows a side view and FIG. 6*c* shows a perspective view also of the first embodiment. FIG. 6*d* shows the rear concave surface of the first embodiment, which is the surface which faces protected glass 14 when the present invention is in its protecting position. FIG. 6*e*–6*h* show a locking-pin suction cup 5 with a second embodiment suction cup 4 having a central hole 21 therethrough. FIG. 6*e* shows a front view of locking-pin suction cup 5 having a tongue release 18 and central hole 21 through a raised central member similar to the raised center portion 24 of string-released suction cup 4 shown in FIG. 6*b*. The rear view of locking-pin suction cup 5 is not shown and would be similar to that shown in FIG. 6*d*, with the addition of a central hole 21 through raised center portion 24. FIG. 6*f* shows locking-pin suction cup 5 having a locking pin 19 centrally extending beyond its convex surface and positioned approximately perpendicular thereto. FIG. 6*g* shows locking pin 19 poised for insertion through the opening 21 in the second embodiment of suction cup 4 from its rear concave surface. FIG. 6*g* also shows locking pin 19 having a uniformly cylindrical shape with an enlargement or flange 20 on one end to prevent locking pin 19 from passing completely through opening 21. FIG. 6*h* shows locking pin 19 in its usable position with flange 20 against the inside concave surface of suction cup 4 and the distal end of locking pin 19 extending beyond the outside convex surface of suction cup 4. Although not identified by a number, FIG. 6*h* shows locking pin 19 having three bores therethrough, perpendicular to its longitudinal axis, for use in attaching padlock 7 to locking pin 19. The number of bores are not critical and would depend upon the thickness of panels 1 as well as the thickness of the locking plate 6 contemplated for use with locking-pin suction cup 5.

FIG. 6*i* shows a front perspective view of a first preferred embodiment of the present invention short-cord suction cup 9 having a suction cup 4 with a tongue release 18 extending upwardly from its top edge, a cord 23 attached on one end to tongue release 18, a ring 11 attached to the distal end of cord 23, and a raised center portion 24 extending beyond the concave outside surface of suction cup 4. Although not shown, during use when raised center portion 24 is attached to the rear surface of a panel 1, a flexible tube housing 10 would be needed between raised center portion 24 and panel 1 to allow a pulling force applied to ring to properly affect tongue release 18 for a quick detachment of suction cup 4 from protected glass 14. FIG. 6*j* shows one possible embodiment of locking plate 6 having a central opening 21 therethrough. Although FIG. 6*j* shows locking plate 6 having a square perimeter, other perimeter configurations are also contemplated, including but not limited to that of a circle, a hexagon, or an octagon. Also, although not critical and although locking plate 6 could be made of other materials, it is contemplated in the preferred embodiment for locking plate 6 to be made from a strong, rigid, and non-corroding metallic material, such as stainless steel. In the alternative, since locking plate 6 is placed against the outside surface of lower panel 1, it could be made from any material that is strong and resists deterioration from weathering elements or has an external coating to help it resist deterioration from weathering elements. The central hole 21 in locking plate 6 should be minimally larger than the diameter of locking pin 19 to provide maximum effectiveness in securing panels 1. FIG. 6*k* shows one proposed embodiment of padlock 7 of the present invention. It is contemplated in the preferred embodiment for padlock 7 to be small, however it should also be made from strong materials to maximize protection against unauthorized entry. It is also considered within the scope of the present invention to have padlocks 7 with non-conventional shapes as long as the shape used does not easily subject padlock 7 to removal from locking pin 19. FIGS. 6*l* and 6*m* show a side-by-side comparison of the preferred embodiments of long-cord suction cup 22 and short-cord suction cup 9 and demonstrate that the only differences between them are the lengths of their cords 23 and the lengths of their flexible tube housings 10. Both long-cord suction cup 22 and short-cord suction cup 9 have a suction cup 4 with a raised center portion 24, a tongue release 18 extending upwardly from the top edge of suction cup 4, and one end of a cord 23 attached centrally to tongue release 18, in addition to a ring 11 attached to the distal end of cord 23 and a substantial portion of cord 23 positioned within a flexible tube housing 10. When attached to the rear surface of a panel 1, it is contemplated that raised center portion 24 will be secured to both flexible tube housing 10 and top panel 1 with flexible tube housing 10 secured between the rear surface of panel 1 and raised center portion 24. For maximum surface area adhesion between panel 1, flexible tube housing 10, and raised center portion 24, it is contemplated that a sufficient quantity of adhesive or bonding agent be applied to the rear surface of panel 1 so that all three are interconnected to one another with flexible tube housing 10 centrally positioned between panel 1 and raised center portion 24.

Figure 7A:
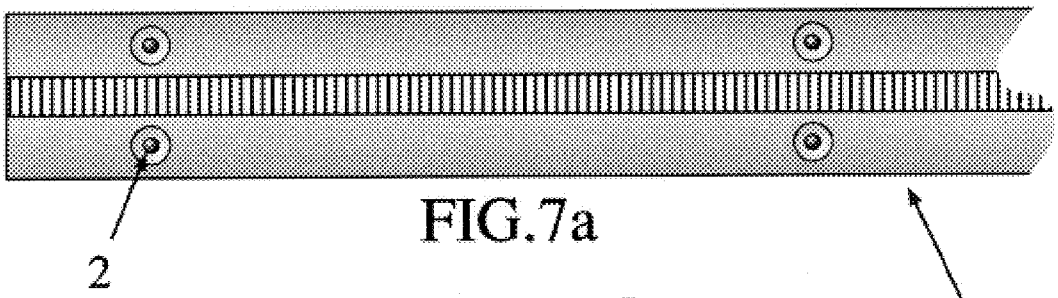
FIG. 7*a* is a front enlarged view of a section of one embodiment of the present invention hinge having two flat strips connected together by a pivoting means which allows the flat strips to move approximately 180° between a horizontally aligned position opened for use and a storage position where each of the strips is in close proximity to the other, as well as spaced-apart hinge fasteners connected through each strip.
Figure 7B:
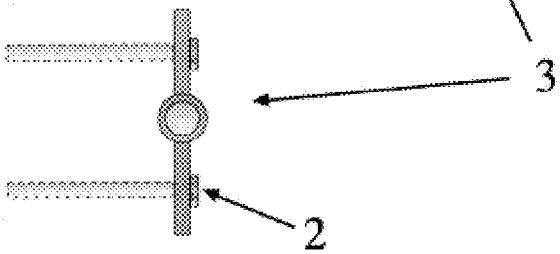
FIG. 7*b* is a side view of the typical present invention hinge.
Figure 7C:
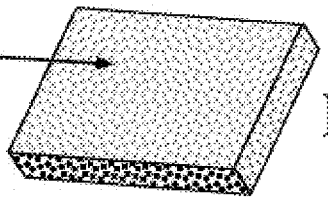
FIG. 7*c* is a perspective view of a typical impact-absorbing foam spacer of the present invention having an essentially rectangular configuration.
Figure 7D:
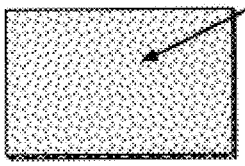
FIG. 7*d* is a top view of the typical impact-absorbing foam spacer of the present invention.
Figure 7E:
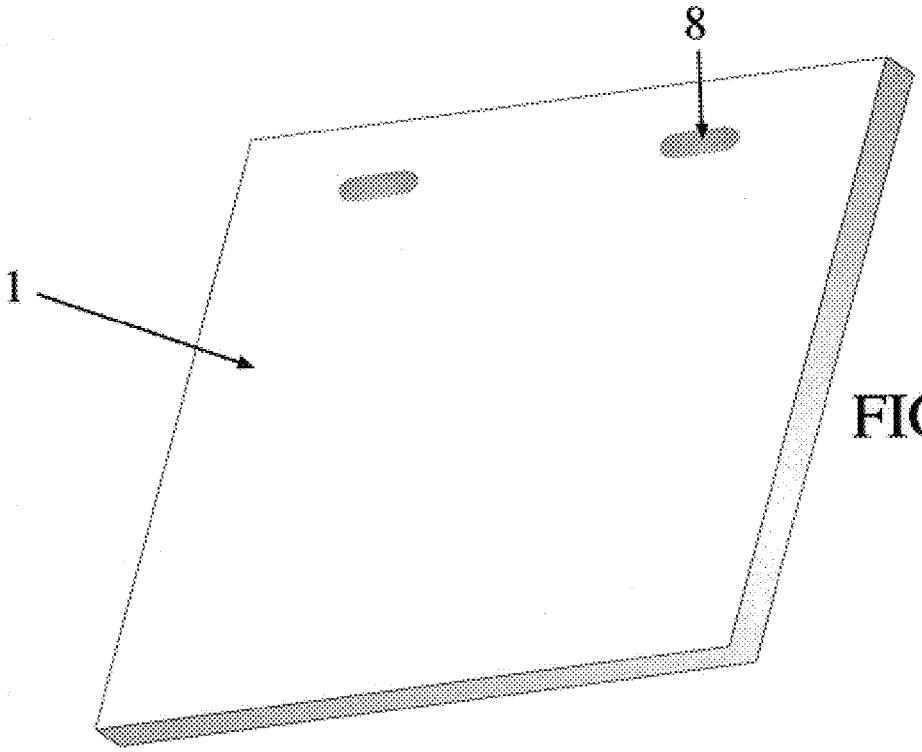
FIG. 7*e* is a perspective view of a typical protective panel used for the present invention having an essentially rectangular configuration and two spaced-apart hand-gripping indentations in its front surface near to its top edge.

FIGS. 7*a* and 7*b* show a preferred embodiment of hinge 3 having the configuration of a piano-hinge with two parallel strips connected lengthwise by a pivoting member so that connected panels 1 can rotate 180° between a flat configuration and a folded configuration where both panels 1 are in close proximity to one another. Spaced-apart hinge fasteners 2 through the top and bottom portions of hinge 3 would secure hinge 3 to adjacent edges of Th upper and lower panels 1. Other types of hinges are also contemplated by the present invention, however they should be made from weather-resistant materials, or have a coating to enhance resistance to deterioration by weathering elements, and be configured to provide a strong connection between upper and lower panels 1 substantially across the entire width of their adjacent edges. If other hinges 3 are used, they must also allow upper panel 1 and lower panel 1 to rotate approximately 180° relative to one another from an essentially planar extended configuration to a compact folded configuration ready for storage in which both panels 1 are approximately parallel to one another. It is also contemplated for more than one hinge 3 to connect upper panel 1 to lower panel 1. FIGS. 7*c* and 7*d* show one embodiment of the spacer blocks made of impact-absorbing foam 12 used in the present invention. Although a rectangular configuration is shown, it is considered within the scope of the present invention for impact-absorbing foam 12 to have other perimeter configurations, such as a circle, hexagon, pentagon, octagon, and the like. At a minimum, one side of impact-absorbing foam must be flat or otherwise configured for good adhesion to the rear surface of panels 1, however the other surfaces of impact-absorbing foam 12 may have any shape or surface texture found suitable. Also, the depth of impact-absorbing foam 12 must be greater than the height of suction cups 4 when suction cups 4 are attached to protected glass 14 and in their compressed form, otherwise impact-absorbing foam 12 cannot properly perform its function of preventing suction cups 4 from easily becoming disengaged from the protected glass 14 upon the impact of airborne debris (not shown) against the front surface of panels 1. It is contemplated for impact-absorbing foam 12 to be made from many types of energy-absorbing material or impact foam, but preferably from materials such as poron polyurethane foam which has a maximum deflection of approximately 30%. The number of spacers of impact-absorbing foam 12 used is not critical, however, the number should be minimally sufficient to protect glass 14 and suction cups 4 during impact from storm debris and vandalism. FIG. 7*e* shows one embodiment of a protective panel 1 of the present invention having two hand-gripping indentations in its front surface, near to its upper edge, for use as handles 8. Although not shown in FIG. 7*e* but shown in FIGS. 4*a* and 4*b*, handles 8 can have a generally triangular-shaped depth dimension. Panel 1 must be made from a rigid, shatter-resistant material with good impact strength which is also resistant to deterioration from weathering elements. Panel 1 may also be opaque, transparent, or translucent depending upon the intended use, and although not shown panel 1 may be made from colored materials, tinted materials, multi-colored materials, and have decorative or advertising markings attached thereto, including company logos or slogans.

Figure 9:
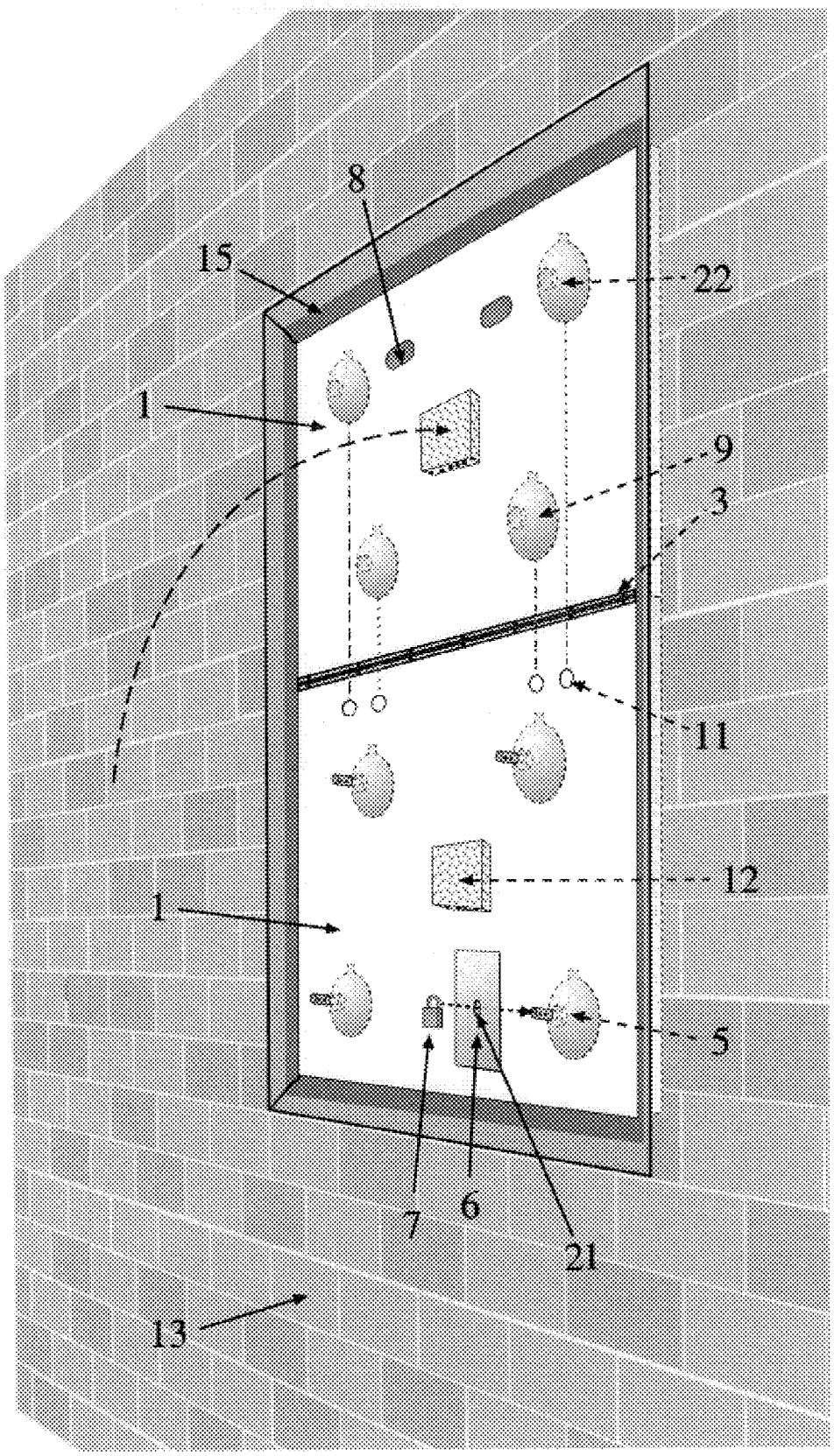
FIG. 9 is a perspective view of the second embodiment of the present invention with both protective panels in their installed positions, a locking plate poised for insertion over one of the locking pins, and a padlock poised for connection to the distal end of the locking pin to secure the present invention against unauthorized removal.
Figure 10:
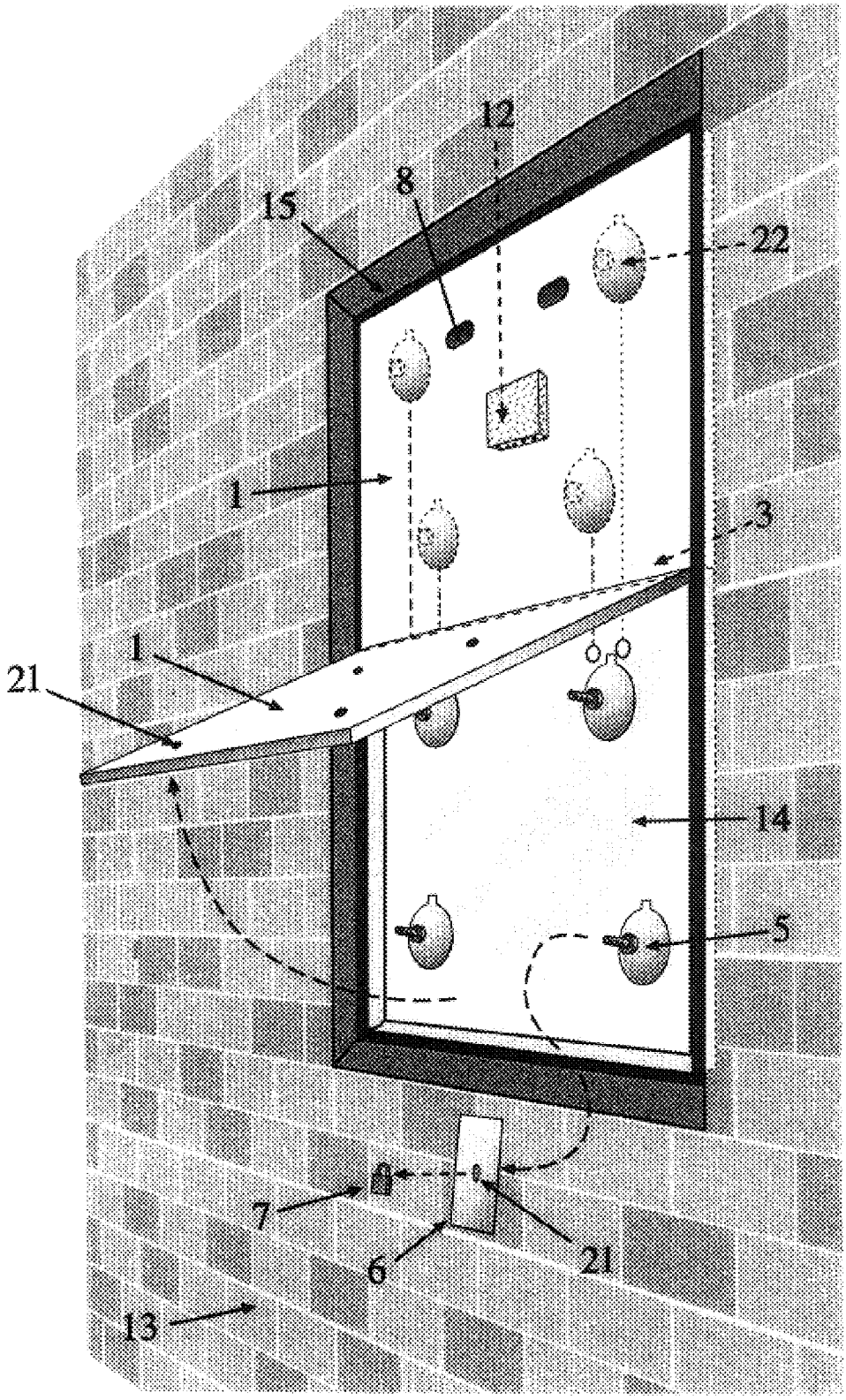
FIG. 10 is a perspective view of the second embodiment of the present invention during its removal from the protected glass with the padlocks and locking plates removed from the locking pins, its lower panel separated from the locking pins and sufficiently raised for access to the rings which when pulled will release attachment of the cord-release suction cups to the protected glass.

FIGS. 8–10 show one preferred method of installing and removing panels 1 from a piece of protected window glass 14. FIG. 8 shows the beginning steps of installation relative to a building wall 13 having a window frame 15 and glass 14 secured within frame 15. FIG. 8 also shows lower panel 1 positioned against the lower part of glass 14, with locking-pin suction cups 5 therebetween near to the bottom edge of lower panel 1. Although not shown, it is contemplated that two additional locking-pin suction cups 5 and a centrally attached piece of impact-absorbing foam 12 would be positioned between lower panel 1 and glass 14. FIG. 8 also shows a padlock 7 and a locking plate 6 poised for connection to one of the locking-pin suction cups 5 so that the locking pin identified in FIGS. 6*f*–*h* by the number 19 and already extending beyond the front surface of lower panel 1, can be inserted through hole 21 in locking plate 6. When padlock 7 is in place and secured to locking pin 19, panel 1 cannot be easily pulled away from locking-pin suction cups 5. FIG. 8 also shows two long-cord suction cups 22 attached to the upper rear surface of upper panel 1 near to its top edge, a block of impact-absorbing foam 12 centrally attached to the rear surface of upper panel 1, and two short-cord suction cups 9 attached to the rear surface of upper panel 1 centrally between impact-absorbing foam 12 and hinge 3. An arrow shows the upward direction of rotation for upper panel 1 to place it in position for attachment to glass 14, as well as the reversed downward direction of rotation of upper panel 1 after disengagement with glass 14.

FIG. 9 shows the second embodiment of the present invention with both protective panels 1 in their installed positions within window frame 15 positioned in a building wall 13. Panels 1 substantially fill the area within window frame 15. An arrow shows the upward direction of movement of upper panel 1 needed to place upper panel 1 in a position where long-cord suction cups 22 and short-cord suction cups 9 can engage the glass 14 within frame 15 to protect it. FIG. 9 further shows hinge 3 extending substantially across the width of both panels 1 to connect them to one another, and rings 11 extending below hinge 3 so that when lower panel 1 is raised during removal of the present invention from glass 14 rings 11 may be pulled to disrupt the engagement of suction cups 4 against glass 14 and allow upper panel 1 to be lifted away from glass 14. FIG. 9 also shows handles 8 positioned in a spaced-apart relation to one another near to the top edge of upper panel 1 and impact-absorbing foam 12 centrally positioned behind each panel 1, and centrally between adjacent suction cups 4. FIG. 9 further shows four locking-pin suction cups 5 positioned between lower panel 1 and glass 14 with locking pins, shown in FIGS. 6*f*–6*h* as number 19, extending beyond the front surface of lower panel 1 for connection through hole 21 in locking plate 6 to a padlock 7. Although for illustration clarity FIG. 9 shows only one locking plate 6 and one padlock 7, it is contemplated for a different locking plate 6 and a padlock 7 to be connected to each locking-pin suction cup 5 used. Padlock 7 helps to secure lower panel 1 against unauthorized removal.

FIG. 10 also shows the second embodiment of the present invention during its removal from protected glass 14 in a frame 15 within building wall 13. FIG. 10 shows padlocks 7 and locking plates 6 removed from locking pins 19, shown as number 19 in FIGS. 6*f*–6*h*, locking pins 19 removed from holes 21 in lower panel 1, and lower panel 1 rotated in an upwardly direction away from protected glass 14 using hinge 3 as a pivoting point. Locking-pin suction cups 5 remain attached to glass 14. Lower panel 1 is upwardly rotated and held until rings 11, extending below hinge 3 and identified in FIG. 9 by the number 11, can be conveniently accessed. The two rings 11 shown in FIG. 10, plus two rings 11 hidden from view by lower panel 1, would then be pulled in a downwardly direction to disrupt the suction attachment of each long-cord suction cup 22 and each short-cord suction cup 9 to glass 14. Impact-absorbing foam 12 allows long-cord suction cups 22 and short-cord suction cup 9 to remain in gripping engagement with glass 14 even though subject to impact from many types of airborne storm and vandalism debris (not shown). Handles 8 positioned near to the top edge of upper panel 1 assist in the easy manipulation of upper panel 1 during its installation and removal from protected glass 14.

FIG. 11 a shows a fourth embodiment of the present invention having a panel 17 with a semi-circular perimeter configuration and having one handle 8 on its front surface as well as two short-cord suction cups 9 connected to its rear surface. Handles 8 could also have the triangular-shaped depth dimension shown for upper panel 1 in FIGS. 4*a* and 4*b*. When indicated by the configuration of the glass 14 needing protection, panel 17 could be used in place of upper panel 1 with a hinge 3 connected to the non-arcuate portion of its perimeter during use. Although not shown, circular window glass 14 could be protected by two panels 17 connected together on their non-arcuate edges by a hinge 3, however, when one panel 17 is used in a manner similar to bottom panel 1, it would not necessarily need handles 8 unless a bottom panel 17 was helping to protect an unusually large piece of glass 14. Also, a panel 17 used in place of bottom panel 1 might have a different selection of suction cups 4 attached to its rear surface than that shown in FIG. 1 la, particularly when at least one locking-pin suction cup 5 is desired to prevent unauthorized removal where security is a concern. Also, for larger panels 17 additional handles 8 and short-cord suction cups 9 would be required for panels 17 to effectively fulfill their functions and long-cord suction cups 22 may also be required. FIG. 11*b* shows that it is contemplated for the same type of short-cord suction cup 9 used for panels 1 to be used to connect panel 17 to protected glass 14. FIG. 11*b* also shows short-cord suction cups 9 used with panels 17 having a suction cup 4 with a tongue release 18 extending upwardly from its top edge, a short cord 23 attached centrally to tongue release 18, a ring 11 attached to the distal end of cord 23, and a portion of cord 23 positioned within a flexible tube housing 10.

Prior to the start of actual installation against protected glass 14 and with the protective panels 1 or 17 folded against one another in an approximately parallel configuration, the preferred embodiment of the present invention would be positioned below a piece of window glass 14 or door glass (not shown) needing protection which had an identical dimension and configuration to that of the joined panels 1 or 17. The raised center portion 24 of each long-cord suction cup 22 and each short-cord suction cup 9 would be already connected to a flexible tube housing 10 and the rear surface of the upper protective panel 1 or 17, with the flexible tube housing 10 positioned between raised center portion 24 and upper panel 1 or 17. In the preferred embodiment it is contemplated for a bonding agent or adhesive (not shown) to connect both raised center portion 24 and flexible tube housing 10 to upper panel 1 or 17. The number of locking-pin suction cups 5 needed for attachment of a lower panel 1 or 17 to protected glass 14 would be assembled and made available for use, but not yet attached to lower panel 1 or 17. Each long-cord suction cup 22 and each short-cord suction cup 9 would have a cord 23 attached on its proximal end to a tongue release 18 on the upper edge of its suction cup 4, with a ring 11 attached to the distal end of cord 23 for ease in releasing attachment of the respective suction cup 4 to which it is attached from the piece of protected glass 14. The cord 23 of each long-cord suction cup 22 and each short-cord suction cup 9 would be inserted through a flexible tube housing 10 so that cord 23 can move vertically within flexible tube housing 10 and a downward force exerted on its attached ring 11 would be transferred to the tongue release 18 and cause prompt release of the respective suction cup 4 to which it is attached from the piece of protected glass 14. Impact-absorbing foam 12 would also be attached to the rear surface of both upper and lower panels 1 or 17 in substantially centered positions between adjacent suction cups 4. Although not critical and not limited thereto, in the preferred embodiment where two rectangular protective panels 1 are used, it is contemplated for the present invention to have two rows of suction cups 4 and one row of blocks of impact-absorbing foam 12, with the suction cups 4 adjacent to hinge 3 in both protective panels 1 being in approximate vertical alignment with one another, all of the impact-absorbing foam 12 attached to both protective panels also being in approximate vertical alignment with one another, and the suction cups 4 remote from hinge 3 in both protective panels 1 being in approximate vertical alignment with one another. It is contemplated for connection of impact-absorbing foam 12, raised center portions 24, and flexible tube housings 10 to panels 1 or 17 to be achieved by any adhesive compound or bonding agent (not shown) that would provide a secure and lasting attachment of one to the other. Also, more than one adhesive compound or bonding agent could be used. Although not pertinent to every installation of the present invention, when excess dirt and debris is adhered to outside surface of the protected glass 14 requiring protection, more secure attachment of the suction cups 4 to the protected glass 14 is achieved by first cleaning the outside surface of glass 14 with soap or detergent and further rinsing it with water where indicated by the type of cleaner used. With the beginning steps of installation completed, the present invention would now be ready for steps of alignment and fastening of panels 1 to protected glass 14, as follows.

Locking-pin suction cups 5 would be secured to the lower portion of the window glass 14 needing protection in the approximate positions of the holes 21 in the protective panel 1 through which the locking pins 19 would be inserted during use, usually the lower protective panel 1 for convenience. The approximate positions for holes 21 could be determined beforehand by measurement and marking glass 14 with a temporary ink or other type of marker (not shown) that would not interfere with the gripping attachment of each suction cup 4 to glass 14. One or more people of ordinary strength and coordination would then raise the combined protective panels 1 so that each locking pin 19 extending through a center hole 21 in the raised center portion 24 of a suction cup 4 attached to glass 14 becomes inserted through one of the holes 21 in lower protective panel 1, and extends beyond the front surface of lower panel 1. The upper protective panel 1, or upper protective panels 1 when more than two protective panels 1 are used, can then be successively rotated in an upward direction until the long-cord suction cups 22 and the short-cord suction cups 9 connected thereto come in contact with the protected glass 14 in a window or door frame 15. Each long-cord suction cup 22 and each short-cord suction cup 9 is then individually pressed into place to insure secure attachment of each suction cup 4 to the protected glass 14. The distal end of each cord 23 and ring 11 should extend downward a sufficient distance below the next adjacent hinge 3 to permit easy gripping of the ring 11 during release of suction cups 4 from the protected glass 14 after use. Once the long-cord suction cups 22 and the short-cord suction cups 9 are firmly attached to the protected glass 14, a protective locking plate 6 with a central hole 21 therethrough can be placed over each locking pin 19 and a padlock 7 attached through the one of several bores in the distal end of each locking pin 19 that best accommodates the particular thickness dimension of the protective panel 1 to which it becomes attached.

Removal of the preferred embodiment of the present invention begins with the unlocking and removal of padlocks 7 from each locking pin 19. Locking plates 6 are also removed from locking pins 19 at this time. Then, while upwardly rotating lower panel 1 using hinge 3 as a pivoting point, and holding lower panel 1 in proximity to the next adjacent upper protective panel 1, a downward force is applied to each ring 11 extending below hinge 3 until the suction cup 4 associated with each pulled ring 11 is released from the protected glass 14. If the present invention would have more than two protective panels 1, the steps of upward rotation and pulling of ring 11 would be repeated until all of the suction cups 4 attached to the topmost protective panel 1 are released from protected glass 14. The protective panels 1 would then be collectively drawn away from the protected glass 14 whereafter the locking-pin suction cups 5 still attached to the protected glass 14 would be released by pulling laterally on the locking pins 19 or by lifting on the tongue release 18 of each suction cup 4. The locking-pin suction cups 5 could then each be loosely attached through one of the holes 21 in lower panel 1 and secured with one of the padlocks 7 being attached to the distal ends of the locking-pin suction cups 5 to prevent loss of removable components during periods of non-use. However, to achieve the most compact configuration of panels 1 or 17, locking-pin suction cups 5, locking plates 6, and padlocks 7 would be stored separately from folded panels 1 or 17. Thus the present invention is attached to the protected glass 14 itself without any tools and without permanent alteration to window or door frame 15, nor to any part of a building wall 13 surrounding frame 15. Protective panels 1 and 17 can be made any size and any configuration to allow protection of round window glass 14, diamond-shaped window glass 14, as well as window glass 14 having an arched or rounded upper perimeter.

What is claimed is:

1. A reusable impact-resisting system for the glass in window and door frames to protect it against storm damage, vandalism, and unauthorized entry, said system capable of being installed without the use of tools and without permanent alteration to the frame or any part of the building surrounding the frame, said system comprising a plurality of rigid panels made of shatter-resistant materials, each of said panels having a front surface for positioning away from a piece of protected glass and an opposed back surface to be positioned facing the piece of protected glass, each of said panels also having opposed edges, one of said opposed edges being a top edge and the other of said opposed edges being a bottom edge, at least one of said opposed edges also being flat for pivotal connection to a flat edge on another one of said panels, all of said panels being connected together in an aligned configuration with adjacent ones of said top and bottom edges being pivotally joined together, said aligned configuration being substantially similar in dimension and configuration to the piece of glass intended for protection;

hinging means connected between said top edges and said bottom edges of adjacent ones of said panels configured to provide at least one pair of contiguous pivotally joined panels consisting of an upper panel and a lower panel, said hinging means also configured for allowing adjacent ones of said panels to move approximately 180° relative to one another from a folded storage position wherein each of said panels in each of said pairs are substantially parallel to one another, to an extended, essentially planar, usable configuration;

a plurality of suction cups each having a tongue release, a convex front surface, and an opposed concave back surface configured for a tight suction grip on a piece of glass when flattened by forces exerted centrally against said convex front surface, said convex front surfaces of at least two of said suction cups being affixed in spaced-apart positions from one another against said back surface of each of said panels during use;

a plurality of impact-absorbing spacers, at least one of said spacers being connected to said back surface of each of said panels and positioned so as to be approximately centered between adjacent ones of said suction cups; and attachment means to firmly secure said spacers and said convex front surfaces of said suction cups to said back surfaces of said panels so that when said panels are in their protective positions against a piece of glass and sufficient tensioning forces are applied to said tongue releases, said suction grip of each of said suction cups on the piece of glass being protected becomes disrupted allowing each of said panels to be lifted away from the protected glass.

2. The system of claim 1 wherein said suction cups are selected from a group consisting of locking-pin suction cups configured to resist unauthorized removal of said panels from their protective positions against a piece of glass, long-cord suction cups, and short-cord suction cups, and wherein each of said long-cord suction cups and each of said short-cord suction cups has a cord with a proximal end and a distal end, each of said proximal ends being connected to said tongue release, each of said cords are configured and dimensioned to allow tensioning forces applied to said distal end to easily disrupt said suction grip, and each of said distal ends also extending beyond said bottom edge of the one of said panels to which its attached suction cup is connected at least a minimum distance that allows suction cup disruption without movement of the one of said panels to which said attached suction cups are connected away from the protected glass.

3. The system of claim 2 wherein at least one of said suction cups is a locking-pin suction cup, wherein said panels have a number of holes therethrough identical to the number of locking-pin suction cups contemplated for use, wherein said locking-pin suction cups each have a locking pin with a distal locking end, wherein the diameter of each of said holes is only slightly larger than said locking pins, and wherein said locking pins are each inserted through a different one of said holes so that said distal locking ends extend beyond said front surface of said panel, and wherein said system further comprises a plurality of locking plates, the number of said locking plates used being identical to the number of said locking-pin suction cups used, each of said locking plates having a central opening slightly larger in diameter than said locking pins, each of said locking plates being positioned over one of said locking pins and against said front surface of one of said panels during use, said system further comprising a plurality of padlocks, the number of said padlocks used being identical to the number of said locking-pin suction cups used, each of said padlocks being connected in front of one of said locking plates to a different one of said distal locking ends during use.

4. The system of claim 1 wherein said attachment means is selected from a group consisting of bonding agents and adhesive compounds.

5. The system of claim 1 further comprising a plurality of hand-gripping indentations being formed into at least one of said panels, the number of said hand-gripping indentations used ranging between a minimum number sufficient to assist in easy manipulation of said panels and a maximum number beyond which said panels would be structurally compromised, each of said hand-gripping indentations having a width dimension adequate for comfortable insertion therein of at least two adult fingers.

6. The system of claim 1 wherein at least a portion of said impact-absorbing spacers are made from impact-absorbing foam.

7. The system of claim 1 further comprising a plurality of rings, and the number of said rings used being identical to the number of said cords used, with each of said rings being connected to said distal end of a different one of said cords.

8. The system of claim 1 further comprising a plurality of flexible tube housings, the number of said flexible tube housings used being identical to the number of said cords used, wherein a substantial length of each of said cords between said proximal and distal ends is positioned within a different one of said flexible tube housings, and further wherein each of said flexible tube housings is connected to said back surface of one of said panels between one of said suction cups and said back surface so that tensioning forces applied to said distal ends of said cords while each is positioned within one of said flexible tube housings can reach and disrupt said suction grip of the attached one of said suction cups.

9. The system of claim 1 wherein said hinging means comprises at least one elongated hinge having a length dimension substantially equal to said opposed edges, the number of said hinges used being one less than the number of said panels, each of said hinges being connected between said top edge and said bottom edge of adjacent ones of said panels, said hinging means also comprising a plurality of hinge fasteners configured for securely connecting said hinges to said front surfaces of said panels and also configured to discourage easy disconnection of said hinges from said front surfaces.

10. The system of claim 1 wherein said panels are selected from a group consisting of square panels, rectangular panels, triangular panels, panels having one of said opposed edges being arcuate and the other of said opposed edges being flat, panels having the perimeter configuration of one-half of an hexagon, panels having the perimeter configuration of one-half of an octagon, panels made from materials which do not readily deteriorate upon exposure to weathering elements, panels which are lightweight with good abrasion resistance and also having good impact strength, panels made from bulletproof materials, panels made from one way thermally conductive materials, opaque panels, transparent panels, translucent panels, tinted panels, colored panels, multicolored panels, and panels having surface decoration.

11. A reusable impact-resisting system for the glass in window and door frames to protect it against storm damage, vandalism, and unauthorized entry, said system capable of being installed without the use of tools and without permanent alteration to the frame or any part of the building surrounding the frame, said system comprising a plurality of rigid panels each made of shatter-resistant materials, each of said panels having a front surface for positioning away from a piece of protected glass and an opposed back surface to be positioned facing the piece of protected glass, each of said panels also having opposed edges, one of said opposed edges being a top edge and the other of said opposed edges being a bottom edge, at least one of said opposed edges also being flat for pivotal connection to a flat edge on another one of said panels, all of said panels being connected together in an aligned configuration with adjacent ones of said top and bottom edges being pivotally joined together, said aligned configuration being substantially similar in dimension and configuration to the piece of glass intended for protection;

hinging means connected between said top edges and said bottom edges of adjacent ones of said panels configured to provide at least one pair of contiguous pivotally joined panels consisting of an upper panel and a lower panel, said hinging means also configured for allowing adjacent ones of said panels to move approximately 180° relative to one another from a folded storage position wherein each of panels said in each of said pairs are substantially parallel to one another, to an extended, substantially planar, usable configuration, said hinging means comprising at least one elongated hinge having a length dimension substantially equal to said opposed edges, the number of said hinges used being one less than the number of said panels, each of said hinges being connected between said top edge and said bottom edge of adjacent ones of said panels, said hinging means also comprising a plurality of hinge fasteners configured for securely connecting said hinges to said front surfaces of said panels and also configured to discourage easy disconnection of said hinges from said front surfaces;

a plurality of suction cups each having a tongue release, a convex front surface, and an opposed concave back surface configured for a tight suction grip on a piece of glass when flattened by forces exerted centrally against said convex front surface, said convex front surfaces of at least two of said suction cups being affixed in spaced-apart positions from one another against said back surface of each of said panels during use, some of said suction cups being cord-release suction cups and at least one of said suction cups being a locking-pin suction cup;

a plurality of cords, some of said cord being longer than the remainder of said cords, each of said cords having a distal end and a proximal end, each of said proximal ends being connected to one of said tongue releases to form one of said cord-release suction cups, each of said cords also being configured, dimensioned and connected to a selected one of said tongue releases in a manner which allows tensioning forces applied to said distal end to easily disrupt said suction grip, and each of said distal ends also extending beyond said bottom edge of the one of said panels to which its attached suction cup is connected at least a minimum distance that allows said suction cup disruption without movement of the one of said panels to which said attached suction cups are connected away from the protected glass;

a plurality of flexible tube housings, the number of said flexible tube housings used hi being identical to the number of said cords used, wherein a substantial length of each of said cords between said proximal and said distal ends is positioned within a different one of said flexible tube housings, and further wherein each of said flexible tube housings is connected to said back surface of one of said panels in between one of said suction cups and said back surface so that tensioning forces applied to said distal ends of said cords while each is positioned within one of said flexible tube housings can reach and disrupt said suction grip of the attached one of said suction cups;

said locking-pin suction cups each having a locking pin with a distal locking end, wherein said panels have a number of holes therethrough identical to the number of locking-pin suction cups contemplated for use, wherein the diameter of each of said holes is only slightly larger than said locking pins, and wherein said locking pins are each inserted through a different one of said holes so that said distal locking ends extend beyond said front surface of said panel, and wherein said system further comprises a plurality of locking plates, the number of said locking plates used being identical to the number of said locking-pin suction cups used, each of said locking plates having a central opening slightly larger in diameter than said locking pins, each of said locking plates being positioned over one of said locking pins and against said front surface of one of said panels during use, said system further comprising a plurality of padlocks, the number of said padlocks used being identical to the number of said locking-pin suction cups used, each of said padlocks being connected in front of one of said locking plates to a different one of said distal locking ends during use;

a plurality of impact-absorbing spacers, at least one of said spacers being connected to said back surface of each of said panels and positioned so as to be approximately centered between adjacent ones of said suction cups; and attachment means to firmly secure said spacers and said convex front surfaces of said cord-release suction cups to said back surfaces of said panels so that when said panels are in their protective positions against a piece of glass and sufficient tensioning forces are applied to those of said distal ends of said cords which are within reach of an operator, said suction grip of each of said attached cord-release suction cups on the glass being protected becomes disrupted, allowing each of said panels to be lifted away from the protected glass.

12. The system of claim 11 further comprising a plurality of hand-gripping indentations being formed into at least one of said panels, the number of said hand-gripping indentations used ranging between a minimum number sufficient to assist in easy manipulation of said panels and a maximum number beyond which said panels would be structurally compromised, each of said hand-gripping indentations having a width dimension adequate for comfortable insertion therein of at least two adult fingers.

13. The system of claim 11 wherein at least a portion of said impact-absorbing spacers are made from impact-absorbing foam.

14. The system of claim 1 further comprising a plurality of rings, and the number of said rings used being identical to the number of said cords used, with each of said rings being connected to said distal end of a different one of said cords.

15. The system of claim 11 wherein said panels are selected from a group consisting of square panels, rectangular panels, triangular panels, panels having one of said opposed edges being arcuate and the other of said opposed edges being flat, panels having the perimeter configuration of one-half of an hexagon, panels having the perimeter configuration of one-half of an octagon, panels made from materials which do not readily deteriorate upon exposure to weathering elements, panels which are lightweight with good abrasion resistance and also having good impact strength, panels made from bulletproof materials, panels made from one-way thermally conductive materials, opaque panels, transparent panels, translucent panels, tinted panels, colored panels, multi-colored panels, and panels having surface decoration.

16. A method for protecting glass in window and door frames against storm damage, vandalism, and unauthorized entry without the use of tools and without permanent alteration of the frame or any part of the building surrounding the frame, said method comprising the steps of providing a piece of framed window glass intended for protection, a plurality of panels all pivotally connected together in an aligned configuration having substantially the same dimension and configuration as said window glass and so as to create at least one upper panel and at least one lower panel, each of said panels having a front surface and an opposed back surface with at least two suction cups attached thereto, some of said suction cups being a permanently affixed cord-release type of suction cup having a hollow flexible tube housing secured between said back surface and said suction cup with said flexible tube housings each having a length dimension configured for extending beyond said pivotal connections, and at least one of said suction cups being a detachable locking-pin type of suction cup, said panels having a number of holes therethrough identical to the number of locking-pin type of suction cups used, said panels each also having at least one impact-absorbing spacer connected between adjacent ones of said suction cups; a number of cords identical to the number of cord-release suction cups used, each of said cords being slightly smaller in diameter than said flexible tube housings; a number of locking plates identical to the number of locking-pin suction cups used, each of said locking plates having a central aperture therethrough; and a number of padlocks identical to the number of locking plates used;

inserting one of the opposite ends of a first one of said cords through a first one of said flexible tube housings to make a first housing-cord combination and so that the other of said opposite ends becomes a distal end extending beyond said first flexible tube housing;

connecting said inserted end of said first cord to the one of said cord-release suction cups attached to said first housing-cord combination;

inserting one of the opposite ends of each of said other cords through a different one of the remaining ones of said flexible tube housings to make additional housing-cord combinations and so that the other of said opposite ends of each of said other cords becomes a distal end extending beyond the one of said flexible tube housings associated with it;

connecting said inserted end of each of the other ones of said cords to the one of said cord-release suction cups attached to said associated housing-cord combination;

positioning said panels in a folded configuration below said framed window glass with said back surface of said lower panel facing said glass so that adjacent ones of said panels can each be successively rotated upwardly from the next lower one of said panels;

optionally cleaning said glass to remove any suction grip diminishing substances thereon;

securing said locking-pin suction cups to said glass in positions aligned with said holes in said panels to allow said locking pins attached to said locking-pin suction cups to be inserted through said holes;

positioning said lower panel in front of said framed window glass so that all of said locking pins attached to said glass become inserted through said panel holes;

upwardly rotating the remainder of said panels in succession while allowing all of said locking pins attached to said framed window glass behind any of said remaining panels to become inserted through said panel holes and also allowing said distal ends of said cords attached to each of said remaining panels to extend partially behind the next lower one of said panels;

pressing each of said panels toward said framed window glass to create a suction grip between each of said suction cups attached thereto and said glass;

positioning said aperture through each one of said locking plates over a different one of said locking pins so that each of said locking plates come into contact with said front surface of the adjacent one of said panels;

connecting each of said padlocks to one of said distal locking ends to secure said panels against unauthorized removal; and removing said panels from said framed window glass for future re-use through the steps of unlocking each of said padlocks; removing all of said padlocks from said locking pins; lifting said locking plates away from said all of locking pins; applying a tensioning force to each of said distal ends extending below said lower panel to downwardly pull said cords until said suction grip between said cord-release suction cups connected to each of said pulled cords and said framed window glass is disrupted; upwardly rotating said lower panel away from said framed window glass until said distal ends of said cords attached to the next adjacent higher one of said panels become accessible; while holding said lower panel away from said framed window glass, applying a tensioning force to each of said accessed distal ends to downwardly pull said cords until said suction grip between the ones of said cord-release suction cups connected to each of said most recently pulled cords and said framed window glass is disrupted; and repeating said steps of upwardly rotating and applying tensioning forces until all of said panels can be lifted away from said glass.

17. The method of claim 16 further comprising the steps of providing a plurality of rings and attaching each of said rings to a different one of said distal ends of said cords.

18. The method of claim 16 wherein the step of providing panels further comprises the step of providing at least one panel having a minimum of one hand-gripping indentation and said method further comprises the step of using said hand-gripping indentations for ease in manipulating said panels during their installation and removal from said framed window glass.

19. The method of claim 16 further comprising the step of providing panels consisting of the providing of panels which are selected from a group consisting of square panels, rectangular panels, triangular panels, panels having one of said opposed edges being arcuate and the other of said opposed edges being flat, panels having the perimeter configuration of one-half of an hexagon, panels having the perimeter configuration of one-half of an octagon, panels made from materials which do not readily deteriorate upon exposure to weathering elements, panels which are lightweight with good abrasion resistance and also having good impact strength, panels made from bulletproof materials, panels made from one-way thermally conductive materials, opaque panels, transparent panels, translucent panels, tinted panels, colored panels, multi-colored panels, and panels having surface decoration.

20. The method of claim 16 further comprising the step of providing suction cups each having a depending tongue release and the step of connecting said cords to said tongue releases.

* * * * *

UNITED STATES PATENT AND TRADEMARK OFFICE

CERTIFICATE OF CORRECTION

PATENT NO. : 6,155,009

DATED : December 5, 1999

INVENTOR(S) : Martin R. Pena

It is certified that error appears in the above-identified patent and that said Letters Patent is hereby corrected as shown below:

On the Title Page, Item [57] Abstract, line 13, delete "It" after "behind the" and before "next".
On the Title Page, Item [57] Abstract, line 21, delete "AS" after "requires tools." and before "Also".
Column 1, line 57, delete "Us" after "can be installed" and before "for the".
Column 7, line 16, delete "is" after "protection of" and befor "the glass".
Column 7, line 62, delete "a" after "below the" and before "hinge".
Column 9, line 2, delete "age" after "top edge of the" and before "suction cup".
Column 12, line 17, after "locking-pin suction cup" insert ---- 5 ----.
Column 14, line 35, after "Fig." insert ---- 3 ----.
Column 14, line 64, delete the space between "Fig. 11" and "a".
Column 17, line 28, after "housing" deleting "IO" and insert ---- 10 ----.
Column 20, line 1, delete "Th" after "edges of" and before "upper".
Column 22, lines 16-17, delete the space between "Fig. 1" and "1a".
Column 27, line 48, delete "hi" after "housings used" and before "being identical"

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*